US006304793B1

(12) United States Patent
Komiya et al.

(10) Patent No.: US 6,304,793 B1
(45) Date of Patent: Oct. 16, 2001

(54) EMBROIDERY DATA EDITING DEVICE

(75) Inventors: Ryohei Komiya; Masashi Ueda, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/139,016

(22) Filed: Aug. 24, 1998

(30) Foreign Application Priority Data

Aug. 26, 1997 (JP) ..... 9-230016

(51) Int. Cl.[7] ..... D05C 5/02; D05B 21/00

(52) U.S. Cl. ..... 700/138; 700/135; 700/136; 700/137; 112/102.5; 112/470.01

(58) Field of Search ..... 700/135, 136, 700/137, 138; 112/102.5, 445, 458, 453, 470.01

(56) References Cited

U.S. PATENT DOCUMENTS

| | | | | |
|---|---|---|---|---|
| 4,502,402 | | 3/1985 | Kato . | |
| 4,869,188 | | 9/1989 | Hyodo . | |
| 5,270,939 | * | 12/1993 | Goldberg et al. | 364/470 |
| 5,323,722 | * | 6/1994 | Goto et al. | 112/121.21 |
| 5,559,711 | * | 9/1996 | Futamura et al. | 364/470.09 |
| 5,751,583 | * | 5/1998 | Kyuno et al. | 364/470.08 |
| 5,778,808 | | 7/1998 | Hirata . | |
| 5,791,271 | * | 8/1998 | Futamura | 112/102.5 |
| 5,896,295 | * | 4/1999 | Matsushita et al. | 364/470.09 |
| 5,911,182 | * | 6/1999 | Uyama et al. | 112/102.5 |

FOREIGN PATENT DOCUMENTS

| | | |
|---|---|---|
| 59-77888 | 5/1984 | (JP) . |
| B2-60-43146 | 9/1985 | (JP) . |
| B2-61-16189 | 4/1986 | (JP) . |
| B2-1-57594 | 12/1989 | (JP) . |
| 6-142358 | 5/1994 | (JP) . |
| 6-264355 | 9/1994 | (JP) . |
| 7-24161 | 1/1995 | (JP) . |
| 7-185158 | 7/1995 | (JP) . |
| B2-2554903 | 8/1996 | (JP) . |
| 9-122366 | 5/1997 | (JP) . |

OTHER PUBLICATIONS

"Specification of Colours According to Their Three Attributes", *Japan Industrial Standard* (JIS) Z8721 (1977), pp. 111–134.

"Specification of Colours According to the CIE 1931 Standard Colorimetric System and the CIE 1964 Supplementary Standard Colorimetric System", *Japan Industrial Standard* (JIS) Z8701 (1982), pp. 93–96.

"Evaluation Method of Degree of Metamerism for Change in Illuminants", *Japan Industrial Standard* (JIS) Z8719 (1984), pp. 179–183.

"Specification of Colour of Materials According to the CIE 1976 (L*a*b*) Space and the CIE (L*u*v*) Space", *Japan Industrial Standard* (JIS) Z8729 (1980), pp. 150–153.

Kobayashi, Shigenobu. "Color Image Scale", ed. Japan Color Design Institute, Kodansha (1990), pp. 6–7 and 66–67.

* cited by examiner

*Primary Examiner*—Robert Beausoleil
*Assistant Examiner*—Tim Vo
(74) *Attorney, Agent, or Firm*—Oliff & Berridge, PLC

(57) ABSTRACT

A memory 36 previously stores therein a plurality of sets of color combination data indicative of a plurality of desirable combinations of colors. Color of a cloth to be sewn is read by a scanner 28. With referring to the memory 36, an embroidery data editing device selects one combination of colors suited for the color of the cloth. The device displays the selected color combination so that a user can confirm the selected color combination. When color of some sewing region is limited to a certain color as stored in the memory 37, hemming embroidery data is added to the embroidery data at an outer rim of the embroidery pattern if needed.

34 Claims, 15 Drawing Sheets

EMBROIDERY DATA EDITING DEVICE

BACKGROUND OF THE INVENTION

1. Field of the Invention

The present invention relates to an embroidery data editing device for editing and correcting embroidery data needed to operate an embroidery sewing machine.

2. Description of Related Art

In order to meet a variety of different taste of users, an embroidery sewing machine has been developed that enables users to design and prepare their own embroidery at home. This embroidery sewing machine is made possible by great improvements in performance of sewing machines.

SUMMARY OF THE INVENTION

FIG. 1 shows a conceivable embroidery sewing machine.

The embroidery sewing machine 140 includes: a card mounting portion 143 to be mounted with an embroidery card 110 prestored with embroidery data; a display portion 146 for displaying a variety of different messages; an embroidery frame 145 for fixedly holding a workpiece cloth on which embroidery is to be sewn; a needle 142 for sewing the embroidery using embroidery thread; an embroidery drive portion 141 for controlling drive of the embroidery frame 145 in association with the needle 142 based on embroidery data stored in the embroidery card 110; operation buttons 148 enabling a user to input a variety of commands into the sewing machine 140; and an embroidery start button 152 for commanding start of embroidery sewing processes.

Next, an explanation will be provided for internal components of the conceivable embroidery sewing machine 140 while referring to FIG. 2.

Internal components of the embroidery sewing machine 140 include a CPU 120 which is capable of controlling a variety of operations. The CPU 120 is connected, via a bus 122, to a needle drive portion 150 for driving the needle 142, and to the embroidery card 110 mounted in the card mounting portion 143, the display portion 146, the embroidery drive portion 141, the operation buttons 148, and the embroidery start button 152.

The embroidery card 110 stores therein data of a plurality of embroidery patterns.

The embroidery patterns will be described below in greater detail.

Each embroidery pattern is constructed from one or more sewing regions, each for being sewn with a single color. It is now assumed that the embroidery card 110 stores therein data of a flower embroidery pattern A shown in FIG. 12. The flower pattern A includes five closed regions A1 through A5, that is, a flower center portion A1, a flower petal portion A2, a stem portion A3, and two left and right leave portions A4 and A5. Coloring of each closed portion A1 to A5 is indicated in FIG. 12 by different types of hatching. In this example, four different colors of thread are required in total to sew the pattern A. Only the closed portions A4 and A5 have the same coloring, and the other closed portions A1 through A3 have different coloring. One or more closed portions which are sewn using the same color are termed "sewing regions." The flower pattern A includes four different sewing regions A1, A2, A3, and A4–A5 as shown in FIGS. 13(*a*) through 13(*d*).

It is noted that the embroidery card 110 is sold together with a plurality of sample sheets (not shown) indicative of the plurality of embroidery patterns, data of which is stored in the embroidery card 110. For example, a sample sheet for the embroidery pattern A of FIG. 12 is printed with a color sample of the flower pattern A where each sewing region is filled with a corresponding proper color.

With the above-described structure, the conceivable embroidery sewing machine 140 operates as described below with reference to FIG. 3.

When a user turns ON the power source (not shown) of the embroidery sewing machine 140, the program of FIG. 3 starts.

First, in S100, the CPU 120 determines whether or not the embroidery card 110 is properly mounted in the card mounting portion 143. If the embroidery card 110 is determined to be properly mounted in the card mounting portion 143 (Yes in S100), then in S102, the CPU 120 retrieves, from the embroidery card 110, the plurality of sets of embroidery data indicative of the plurality of embroidery patterns.

Next in S104, the CPU 120 controls the display portion 146 to display images representing the plurality of embroidery patterns based on the embroidery data retrieved from the embroidery card 110. While referring to the images displayed on the display portion 146, the user selects one embroidery pattern desired to be sewn. That is, in S106, the user inputs his/her selection by operating the operation buttons 148.

When receiving the user's inputted embroidery selection command, the CPU 120 controls in S108 the display portion 146 to display one of the sewing regions constituting the selected embroidery pattern. If the user has selected in S106 the flower pattern A of FIG. 12, the CPU 120 controls the display portion 146 to display, as shown in FIG. 13(*a*), one sewing region (A1 in this example) to be sewn first.

When the sewing region of the user's selected embroidery pattern is thus displayed in S108, then the user visually compares the displayed sewing region with the color sample sheet showing the selected embroidery pattern. The user determines a color for the displayed sewing region to be the same as that shown in the sample sheet for that sewing region. Then, the user threads the needle 142 with an embroidery thread of the determined color, and presses the embroidery start button 152 in S110, whereupon embroidery operations are started for sewing the displayed sewing region with the presently-set thread.

It is noted that the embroidery card 110 may be prestored with data indicating one embroidery color predetermined for each sewing region. In this case, the CPU 120 determines the embroidery color of each sewing region and displays in S108 the embroidery color on the display portion 146. This enables the user to easily determine which color embroidery thread should be set in the needle 142. It becomes unnecessary for the user to compare the displayed pattern with the sample sheet.

Once sewing of the sewing region started in S110 has been completed, then the program proceeds to S112. In S112, the CPU 120 determines whether or not all the sewing regions of the selected embroidery pattern have been completely sewn.

When it is determined that all the sewing regions have not yet been sewn (No in S112), then the program returns to S108, whereupon a next sewing region is displayed. In the example of FIGS. 12–13, when the first sewing region A1 has been sewn, the next sewing region A2 is displayed in S108 and is sewn in S110. Then, the program returns through S112 to S108. Thus, the sewing regions A1–A5 are successively sewn in the repeatedly-executed processes of S108–S112. When it is determined that all the sewing regions have been completely sewn (Yes in S112), then one series of sewing operations are completed, and the user's selected embroidery pattern is sewn. Then, this process ends.

On the other hand, when it is determined in S100 that the embroidery card 110 is not properly mounted (No in S100), then the program proceeds to S120, where the CPU 120 displays on the display portion 146 a message urging the user to properly mount the embroidery card 110 and to again turn ON the power source. Afterwards, these processes are ended.

According to the above-described conceivable method, however, the user selects the color of embroidery thread based on the predetermined embroidery sample or on the predetermined embroidery color data stored in the embroidery card 110. Accordingly, colors in which embroidery patterns could be sewn is limited to the same predetermined colors.

It is conceivable for the user to select embroidery colors other than those indicated by embroidery samples or by the embroidery card. However, selecting suitable colors takes a fair amount of designed sense and so is often difficult for the general user to perform.

This problem will be described in more detail below.

Embroidery patterns are normally sewn on cloth having some sort of color or pattern itself. When the color or pattern of the cloth approximates the pattern or color of the embroidery pattern, then the embroidery pattern will blend in with the cloth pattern or cloth color so it becomes difficult to discriminate the embroidery pattern from the cloth itself.

For example, if the flower pattern A of FIG. 12 is embroidered onto cloth having coloring similar to the coloring of the flower petal portion A2, then the color of the flower petal portion A2 will blend in with the color of the cloth as shown in FIG. 14 so that the flower petal A2 will be difficult to perceive.

It is therefore an objective of the present invention to overcome the above-described problems and to provide an improved embroidery data editing device which is capable of editing and correcting colors for embroidery data so that the colors become more suitable to a user's desire and characteristics of the cloth on which the embroidery is to be sewn.

In order to attain the above and other objects, the present invention provides an embroidery data editing device for editing data to be used in an embroidery sewing machine capable of sewing embroidery, the embroidery data editing device comprising: sewing region data storing means for storing at least one set of sewing region data indicative of at least one sewing region constituting an embroidery, each sewing region being defined as a region to be sewn by a single color, each set of sewing region data including sewing data indicative of stitches to be sewn in the corresponding sewing region; cloth data memory means for storing cloth data indicative of color of cloth to be sewn with the embroidery; color combination data memory means for storing a plurality of sets of color combination data indicative of a plurality of desirable color combinations, each desirable color combination including a plurality of colors; and embroidery color setting means for setting an embroidery color for each sewing region, indicated by the sewing region data for the embroidery to be sewn, based on the color combination data sets and on the cloth data.

The embroidery color setting means may include: color combination selection means for selecting one set of color combination data suited for the color of the cloth indicated by the cloth data; and color setting means for respectively setting at least one of the plurality of colors, constituting the selected color combination, to the at least one sewing region.

According to another aspect, the present invention provides an embroidery data editing device for editing data to be used in an embroidery sewing machine capable of sewing embroidery, the embroidery data editing device comprising: embroidery data storing means for storing embroidery data indicative of an embroidery; a sense keyword memory for storing data of a plurality of sense keywords representative of a plurality of sensations; sense information input means for enabling a user to input information on desired sensation for the embroidery to be sewn; and sewing condition setting means for setting a sewing condition for the embroidery based on the sense keyword data stored in the sense keyword memory and the sensation information inputted by the sense information input means.

According to still another aspect, the present invention provides an embroidery data editing device for editing data to be used in an embroidery sewing machine capable of sewing embroidery, the embroidery data editing device comprising: embroidery data storing means for storing embroidery data indicative of an embroidery; cloth data memory means for storing cloth data indicative of an optical state of cloth to be sewn with the embroidery; and sewing condition setting means for setting a sewing condition for the embroidery based on the cloth data.

According to another aspect, the present invention provides a method for editing data to be used in an embroidery sewing machine capable of sewing embroidery, the method comprising the steps of: receiving information on color of a cloth to be sewn with an embroidery in the form of digital data, the embroidery having at least one sewing region, each sewing region being defined as a region to be sewn by a single color; producing cloth data based on the digital data; selecting one set of color combination data, suited for the color of the cloth indicated by the cloth data, from a plurality of sets of color combination data indicative of a plurality of desirable color combinations, each desirable color combination including a plurality of colors; and respectively setting at least one of the plurality of colors, constituting the selected color combination, to the at least one sewing region of the embroidery.

According to still another aspect, the present invention provides a method of editing data to be used in an embroidery sewing machine capable of sewing embroidery, the method comprising the steps of: preparing data of a plurality of sense keywords representative of a plurality of sensations; receiving information on a user's desired sensation for an embroidery to be sewn; and setting a sewing condition for the embroidery based on the sense keyword data and the received sensation information.

According to a further aspect, the present invention provides a program data storage medium for storing data of a program for editing data to be used in an embroidery sewing machine capable of sewing embroidery, the program comprising the programs of: receiving information on color of a cloth to be sewn with an embroidery in the form of digital data, the embroidery having at least one sewing region, each sewing region being defined as a region to be sewn by a single color; producing cloth data based on the digital data; selecting one set of color combination data, suited for the color of the cloth indicated by the cloth data, from a plurality of sets of color combination data indicative of a plurality of desirable color combinations, each desirable color combination including a plurality of colors; and respectively setting at least one of the plurality of colors, constituting the selected color combination, to the at least one sewing region of the embroidery.

BRIEF DESCRIPTION OF THE DRAWINGS

The above and other objects, features and advantages of the invention will become more apparent from reading the following description of the preferred embodiment taken in connection with the accompanying drawings in which:

FIG. 15(*b*) illustrates how hemming data is produced to sew outer ridges of the sewing regions of FIGS. 13(*c*) and 13(*d*), thereby making the sewing regions discernible from the background cloth region.

DETAILED DESCRIPTION OF THE PREFERRED EMBODIMENTS

An embroidery data editing device according to preferred embodiments of the present invention will be described below while referring to the accompanying drawings.

An embroidery data editing device according to a first preferred embodiment of the present invention will be described below with referring to FIGS. 4–9.

Figure 4:
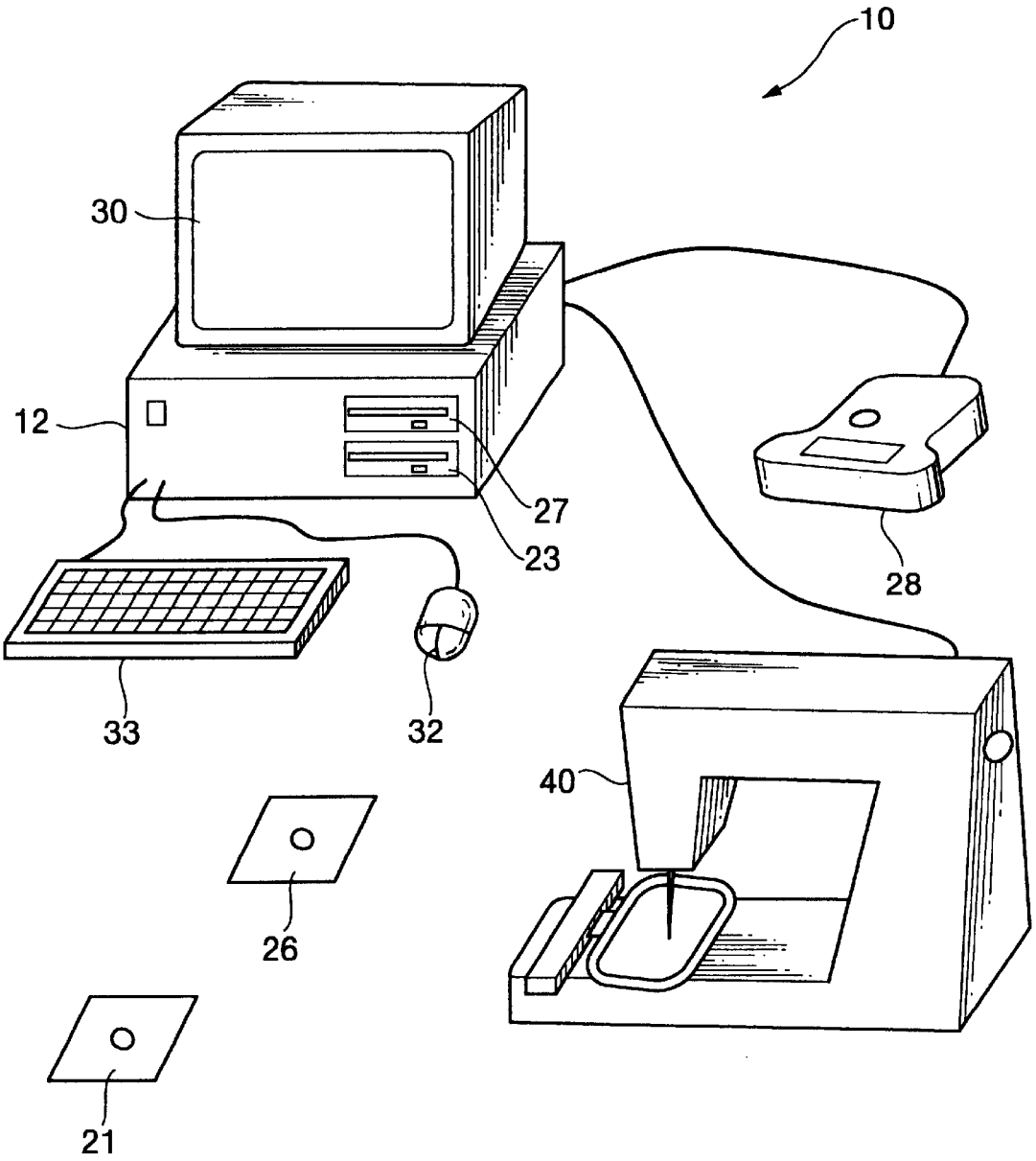
FIG. 4 is an embroidery data editing device according to a first embodiment of the present invention.

As shown in FIG. 4, the embroidery data editing device 10 of the present embodiment includes: a personal computer 12, an embroidery sewing machine 40, and a scanner 28. The personal computer 12, the embroidery sewing machine 40, and the scanner 28 are connected to one another to enable transmission of data thereamong.

The embroidery sewing machine 40 is the same as the conceivable embroidery sewing machine 140 except that the embroidery sewing machine 40 is not provided with the card mounting portion 143, the buttons 148 and 152, or the display 146. The embroidery sewing machine 40 is designed to be controlled directly by the personal computer 12. That is, the needle 142 and the embroidery frame 145 (not shown) of the sewing machine 40 can be controlled directly by the computer 12.

The personal computer 12 is connected to: a cathode ray tube (CRT) 30, a mouse 32, and a keyboard 33 to enable mutual transmission of data therebetween.

The CRT 30 is for displaying various images and messages. The mouse 32 and the keyboard 33 are for inputting a user's desired instructions. The scanner 28 is for scanning a cloth to be sewn and for producing RGB color signals (Ri, Bi, Gi) at each scanning point on the cloth.

The personal computer 12 is provided with a card drive 27, in which can be mounted an embroidery card 26. The embroidery card 26 is the same as that of the conceivable embroidery card 110 except that the embroidery card 26 is not stored with embroidery color data indicative of colors of the embroidery patterns.

The personal computer 12 is also provided with an external storage device 23 such as a floppy disk drive, in which can be mounted a data storage medium 21.

Figure 5:
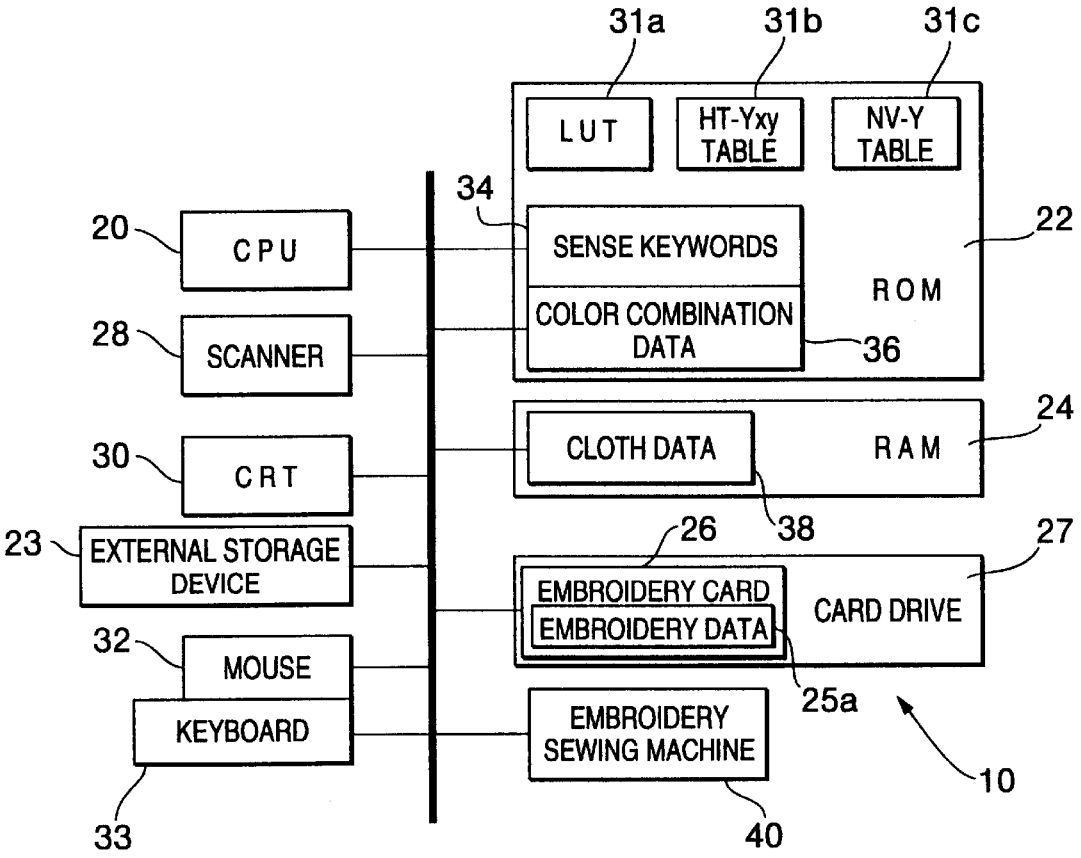
FIG. 5 is a block diagram of a control structure of the embroidery data editing device of FIG. 4.

Next, the internal structure of the embroidery data editing device 10 will be described while referring to FIG. 5.

The personal computer 12 includes a CPU 20, a ROM 22, and a RAM 24. The CPU 20 is connected to enable transmission and reception of data with the ROM 22, the RAM 24, the card drive 27, the scanner 28, the CRT 30, the mouse 32, the keyboard 33, the external storage device 23, and the sewing machine 40.

The CPU 20 is for performing control of a variety of operations. For example, the CPU 20 controls the sewing machine 40, i.e., the needle 142 and the embroidery frame 145 based on embroidery data, thereby sewing embroidery patterns on working clothes.

When the embroidery card 26 is inserted into the card drive 27, the CPU 20 is capable of using the card drive 27 to retrieve information stored on the embroidery card 26.

The RAM 24 is prepared with a region 38 for temporarily storing RGB color data (Ri, Gi, B1) supplied from the scanner 28 and for storing cloth color data (Rcloth, Gcloth, Bcloth) calculated based on the RGB color data (Ri, Gi, Bi).

Figure 9:
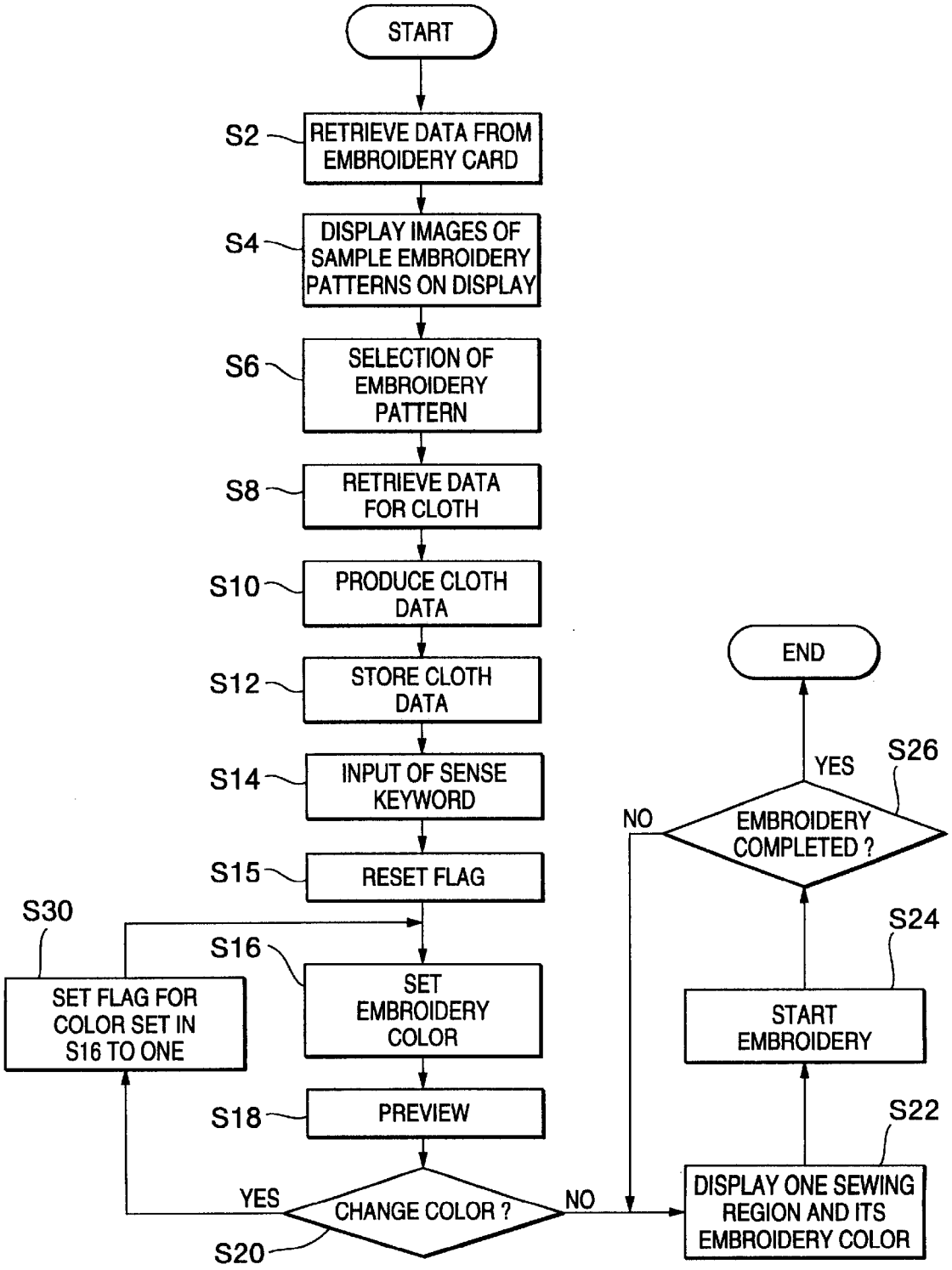
FIG. 9 is a flowchart illustrating operation of the embroidery data editing device of FIG. 4.
Figure 10:
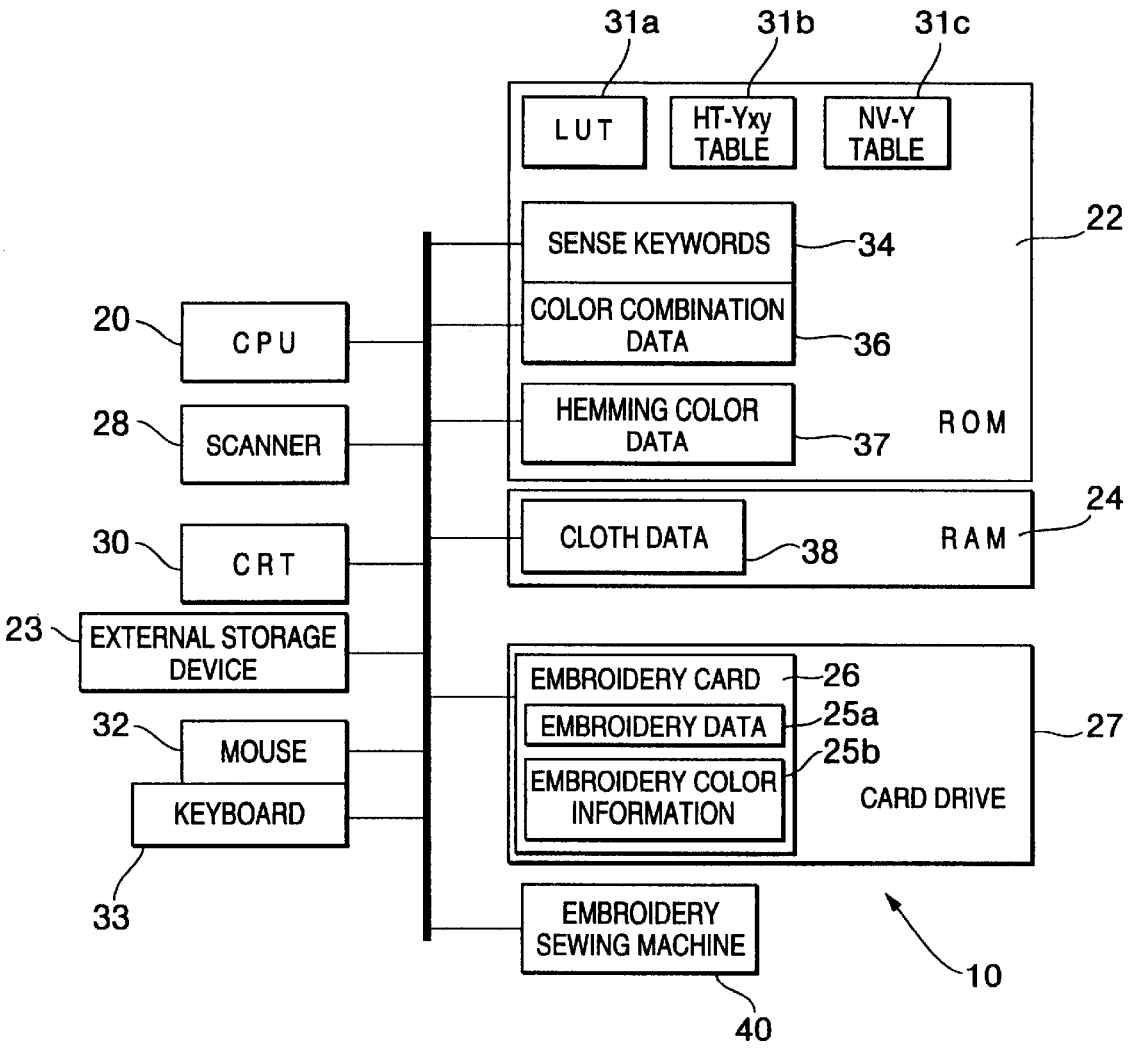
FIG. 10 is a block diagram of a control structure of an embroidery data editing according to a second preferred embodiment of the present invention.

The ROM 22 stores therein data of a program of an embroidery data editing/sewing process shown in FIG. 9. The program is executed by the CPU 20 when required. It is noted that data of the program may be previously stored in the data storage medium 21 such as a floppy disk, a magnetooptical disk, a CD-ROM or the like. When required, data of the program is retrieved from the data storage medium by the operation of the external storage device 23 and is written into a working memory prepared in the RAM 24.

The ROM 22 further stores therein a three-dimensional look up table (LUT) 31*a,* a HT-Yxy table 31*b,* and a NV-Y table 31*c*. The ROM 22 also includes a memory area 34 for storing a plurality of sets of sense keyword data. The ROM 22 further includes another memory area 36 for storing therein one or more sets of color combination data in association with each set of sense keyword data stored in the memory area 34.

Details of the embroidery card 26 will be described below.

The card 26 is formed with an embroidery data memory area 25*a* for storing a plurality of sets of embroidery data indicative of a plurality of embroidery patterns. Each set of embroidery data indicates one or more sewing regions defined in a corresponding embroidery pattern and stitches to be sewn in each of the sewing regions. More specifically, data of each embroidery pattern is constructed from: a set of display data and a set of sewing data. The display data is for controlling the display 30 to display a corresponding embroidery pattern on the screen. The sewing data is for controlling the sewing machine 40 to sew a corresponding embroidery pattern.

As shown in Table 1 shown below, the embroidery memory area 25*a* is divided into different regions storing: display data for each embroidery pattern; sewing data for each embroidery pattern; and data indicative of a lead address of each set of display data and sewing data.

TABLE 1

| MEMORY AREA 25a |
|---|
| Lead address of display data of first embroidery pattern |
| Lead address of sewing data of first embroidery pattern |
| Lead address of display data of second embroidery pattern |
| Lead address of sewing data of second embroidery pattern |
| Lead address of display data of third embroidery pattern |
| Lead address of sewing data of third embroidery pattern |
| . . . |
| display data for first embroidery pattern |
| display data for second embroidery pattern |
| display data for third embroidery pattern |
| . . . |
| sewing data for first embroidery pattern |
| sewing data for second embroidery pattern |
| sewing data for third embroidery pattern |
| . . . |

Figure 12:
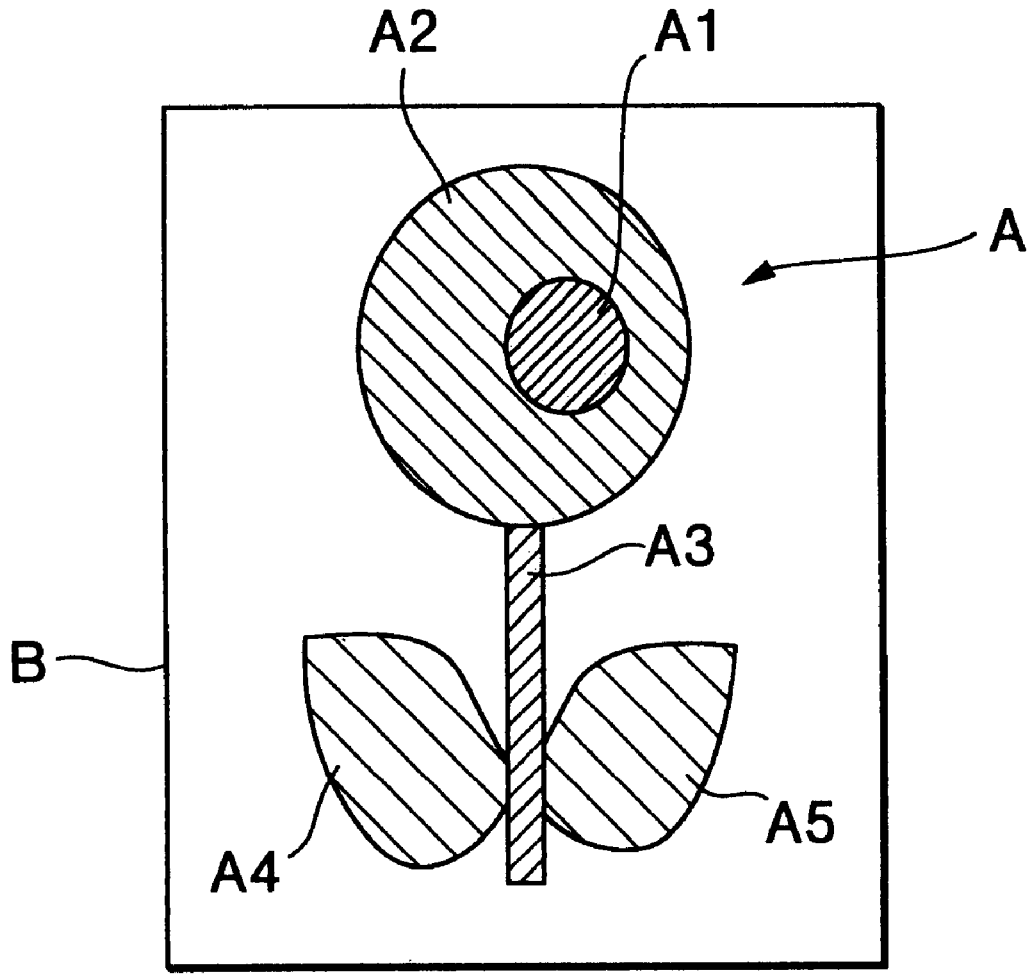
FIG. 12 illustrates one example of an embroidery pattern.
Figure 13A:
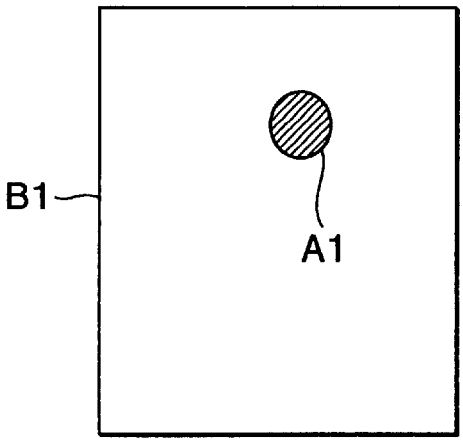
FIGS. 13(*a*) through 13(*d*) show sewing regions in the embroidery pattern of FIG. 12.
Figure 13B:
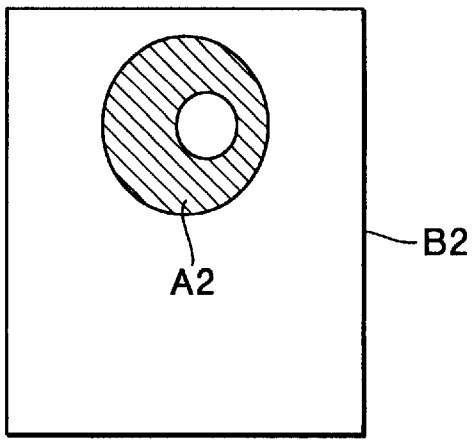
Figure 13C:
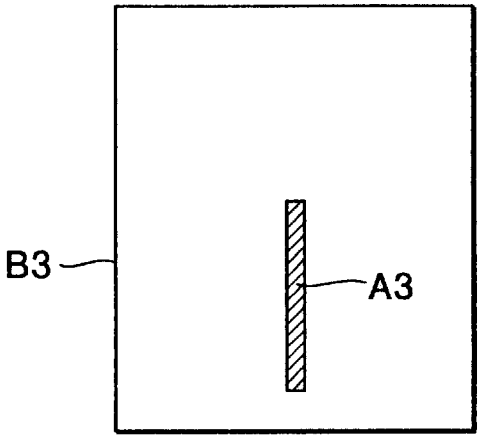
Figure 13D:
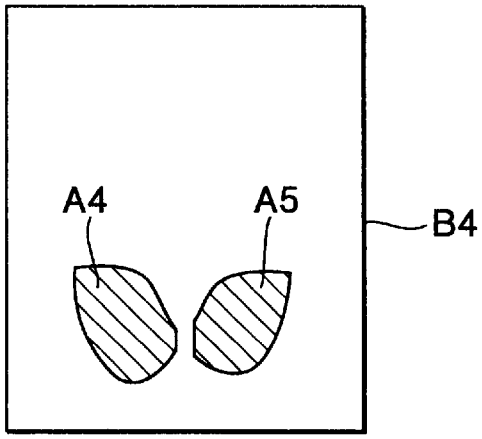
Figure 14:
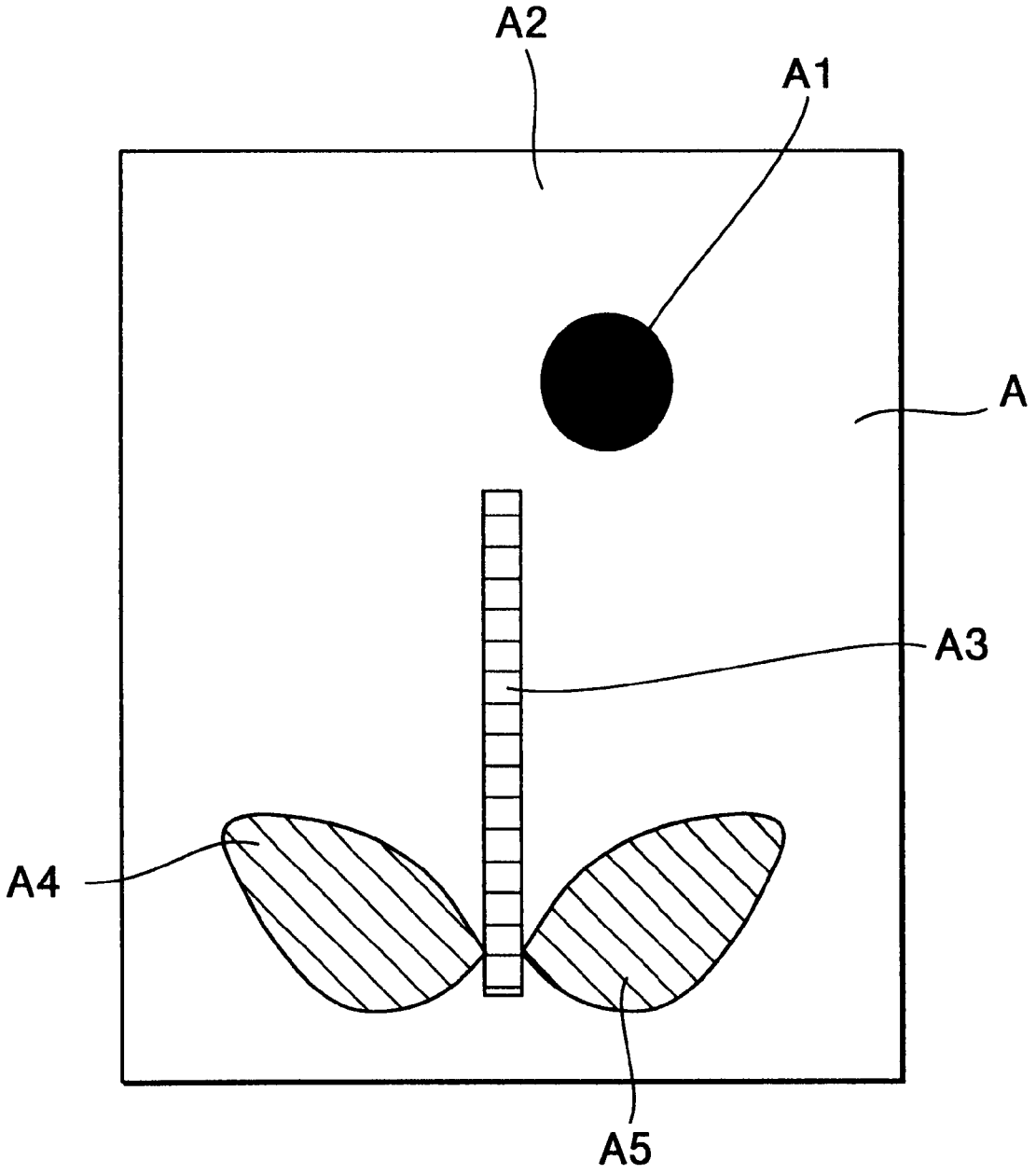
FIG. 14 illustrates the embroidery pattern of FIG. 12 when color approximate to the cloth color is erroneously set to one sewing region of FIG. 13(*b*)

It is noted that each embroidery pattern is constructed from one or more sewing regions, each being to be sewn with a single color. For example, the flower embroidery pattern A of FIG. 12 is constructed from four sewing regions: A1, A2, A3, and A4–A5.

The display data for each embroidery pattern includes one or more sets of partial display data, each data set being for controlling the CRT 30 to display a corresponding sewing region.

Similarly, the sewing data for each embroidery pattern includes one or more sets of partial sewing data, each data set being for controlling the sewing machine 40 to sew a corresponding sewing region. The partial sewing data for each sewing region includes a plurality of sets of stitch-position data to form stitches filling the inside area of the corresponding region. Thus, the partial sewing data for each sewing region indicates: stitches to be sewn in the subject sewing region and positional information of the subject sewing region. Each set of stitch-position data represents a stitch position where the sewing needle 142 is to penetrate the work piece to form a corresponding stitch. Each set of stitch-position data also indicates amounts of movement of the work piece or the embroidery frame 145 to form a corresponding stitch. It is noted that the partial embroidery data for each sewing region also includes a set of outline data indicative of an outline of the subject sewing region. The set of outline data is produced from some of the plurality of sets of stitch-position data that represent the contour of the sewing region.

Next, details of the memory areas 34 and 36 will be described.

The memory area 34 is prestored with the plurality of sets of sense keyword data indicative of a plurality of sensations or impressions a user may wish for embroidery patterns to induce in viewers of the embroidery patterns. Representative examples of the sensations include: "crystalline", "childlike", "grand", "enjoyable", "mysterious", "elegant", "gorgeous", "romantic", "dreamy", etc. Each sense keyword data is comprised of text data indicative of the corresponding sensation.

The memory area 36 is prestored with one or more sets of color combination data in association with each set of sense keyword data stored in the memory area 34. With this structure, each sense keyword is appended with at least one or more sets of color combination data. The number of sets of color combination data appended to each sense keyword need not be the same for all the sense keywords.

Each set of color combination data, stored in association with one sense keyword data, indicates a color combination comprised of a plurality of colors. The color combination is designed to evoke the sensation indicated by the corresponding sense keyword in people viewing the color combination. Thus, all the color combination data sets, stored in association with each sense keyword, are representative of color combinations that can give their viewers the same sensation indicated by the sense keyword.

Each set of color combination data is stored as a group of a plurality of color data sets "COLOR" indicative of the plural colors constituting the corresponding color combination. The color data "COLOR" indicative of each color is defined according to a hue/tone color scheme predetermined and described in *Color Image Scale* written by Shigenobu Kobayashi, edited by Japan Color Design Institute, and published by Kodansha (1990).

According to this hue/tone color scheme, color data COLOR is defined by "H/T" or "NV". That is, when the color data COLOR indicates some chromatic color, the data COLOR is defined by H/T. When the color data COLOR indicates some achromatic color, on the other hand, the data COLOR is defined by NV.

According to the hue/tone color scheme, each chromatic color is expressed in terms of two symbols "H/T": a first symbol H being indicative of hue of the color; and a second symbol T being indicative of tone of that color.

There are ten different hues H: red (R), orange (YR), yellow (Y), green yellow (GY), green (G), blue green (BG), blue (B), purple blue (PB), purple (P), and red purple (RP). That is, H=R, YR, Y, GY, G, BG, B, PB, P, or RP. Each hue H has a certain range from 0H–10H. Accordingly, each hue is represented by one representative hue value 5H, for example.

Figure 6:
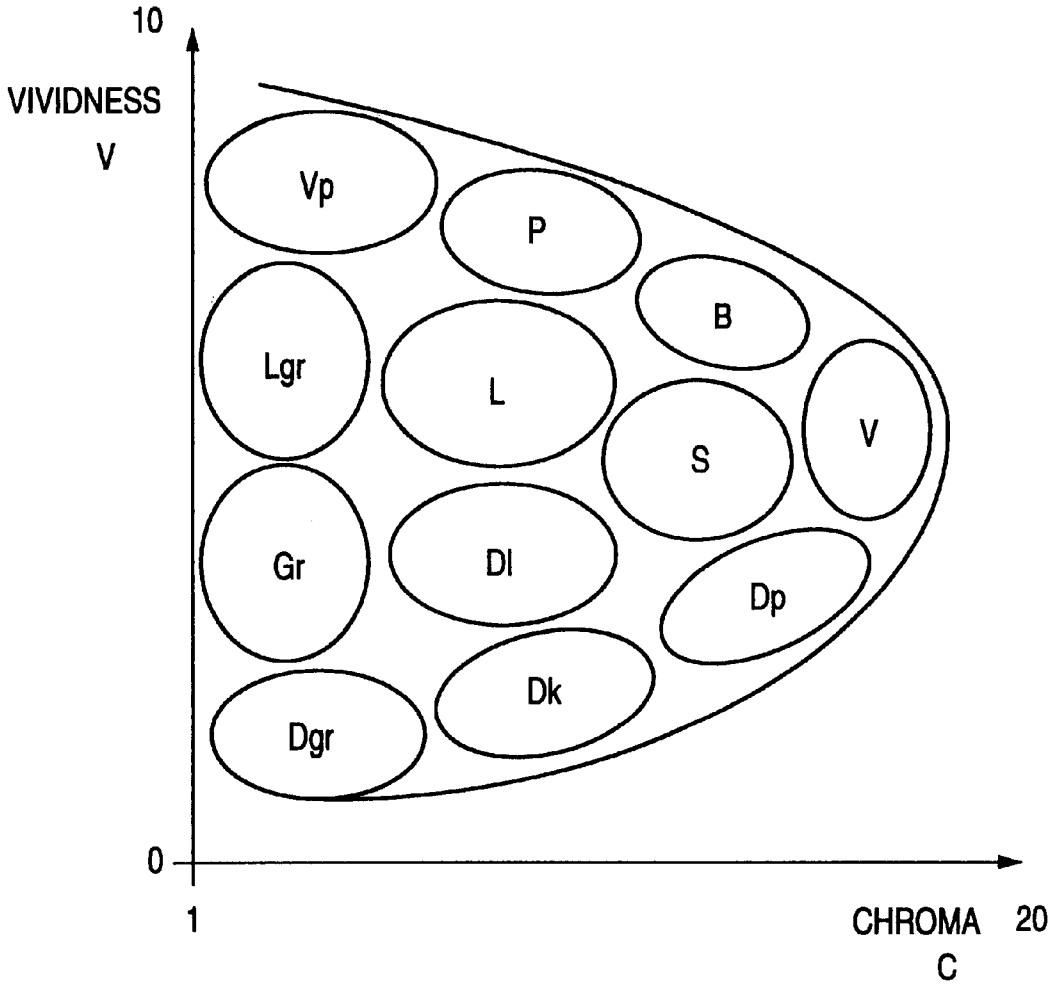
FIG. 6 illustrates a graph showing tones defined by chroma and vividness.

There are twelve different tone regions T defined by: chroma C ranging from one (1) to about twenty (20); and vividness V ranging from zero (0) to ten (10). FIG. 6 shows a graph indicating all the twelve tone regions T relative to chroma (horizontal axis) C and vividness (vertical axis) V. Each tone region is defined by a range of the pair of values of V (vividness) and C (chroma). The twelve tones T include: vivid tone (V), strong tone (S); bright tone (B), pale tone (P), very pale tone (Vp), light grayish tone (Lgr), light tone (L), grayish tone (Gr), dull tone (Dl), deep tone (Dp), dark tone (Dk), and dark grayish tone (Dgr). That is T=V, S, B, P, Vp, Lgr, L, Gr, Dl, Dp, Dk, or Dgr. The tones V and S are showy tones. The tones B, P, and Vp are bright tones. The tones Lgr, L, Gr, and Dl are sober tones. The tones Dp, Dk, and Dgr are dark tones. It is noted that each tone T has a certain region ranging along the axes V and C. Each tone T is therefore represented by one representative pair of values V and C.

Achromatic colors, such as white, gray, and black, have no hue, and have chroma or saturation of zero (0). Therefore, achromatic colors are represented by a ten scale of vividness V, only, so that white is represented by N10 and black is represented by N0 where N means "neutral". In other words, achromatic colors can be represented by NV where 0≦V (vividness)≦10. The vividness value V may be any numbers located between zero (0) and ten (10). Values such as N4.5 that include decimal numbers can be used without reservation.

Each set of color combination data is designed to include three or more colors, each color being indicated by color data COLOR (=H/T or NV) defined by the above-described hue/tone colorimetric scheme.

Examples of the sense keyword data and the color combination data stored in the regions 34 and 36 are shown in Table 2 below.

TABLE 2

| <region 36> | <region 34> |
|---|---|
| sense keyword | color combination |
| crystalline | (G/Lgr, PB/P, N9.5), (BG/P, N9.5, B/P) (BG/Vp, N9.5,PB/P), (B/Vp, N9.5, PB/L), . . . |
| childlike | (R/B, Y/Vp, B/P), (R/P, Y/P, G/P), (RP(B, Y/P, B/P), . . . |
| grand | (Y/S, XR/Dp, N1.5), (YR/Dgr, GY/Dp, N2) (BG/Vp, G/Gr, RP/Dgr), (B/Lgr, BG/S, BG/Dk), . . . |
| enjoyable | (YR/V, Y/V, B/B), (R/B, Y/P, G/B) (RP/B, B/B, Y/B), (GY/P, RP/B, PB/S), . . . |
| mysterious | (BG/S, P/Dp, PB/S), . . . |

As shown in Table 2 above, one or more sets of color combination data are stored in the region 36 in association with each of the sense keyword data stored in the region 34. Each sense keyword represents a sensation evoked in people viewing a color combination represented by each of the corresponding one or more sets of color combination data.

For example, the first color cobination data for the sense keyword "enjoyable" includes: YR/V (orange/vivid), Y/V (yellow/vivid), and B/B (blue/bright). Becuase YR/V (yellow/vivid) indicates a color "orange," Y/V (yellow/vivid) indicates a color "yellow," and B/B (blue/bright) inndicates a "sky blue," the color combination "YR/V, Y/V, and B/B" indicates a combination of colors of "orange", "yellow" and "sky blue".

The second color combination data for the sense keyword "crystalline" includes: BG/P (blue/pale) indicative of "light aqueous green," N9.5 (neutral 9.5) indicative of almost "white," and B/P (blue/pale) indicative of "aqueous blue."

It is noted that although each color combination data set shown in Table 2 includes three colors, combinations of four or five colors or even more colors are also stored in the memory region 36 in correspondence with each sense keyword.

Next, details of the LUT 31*a* will be described below.

Figure 7:
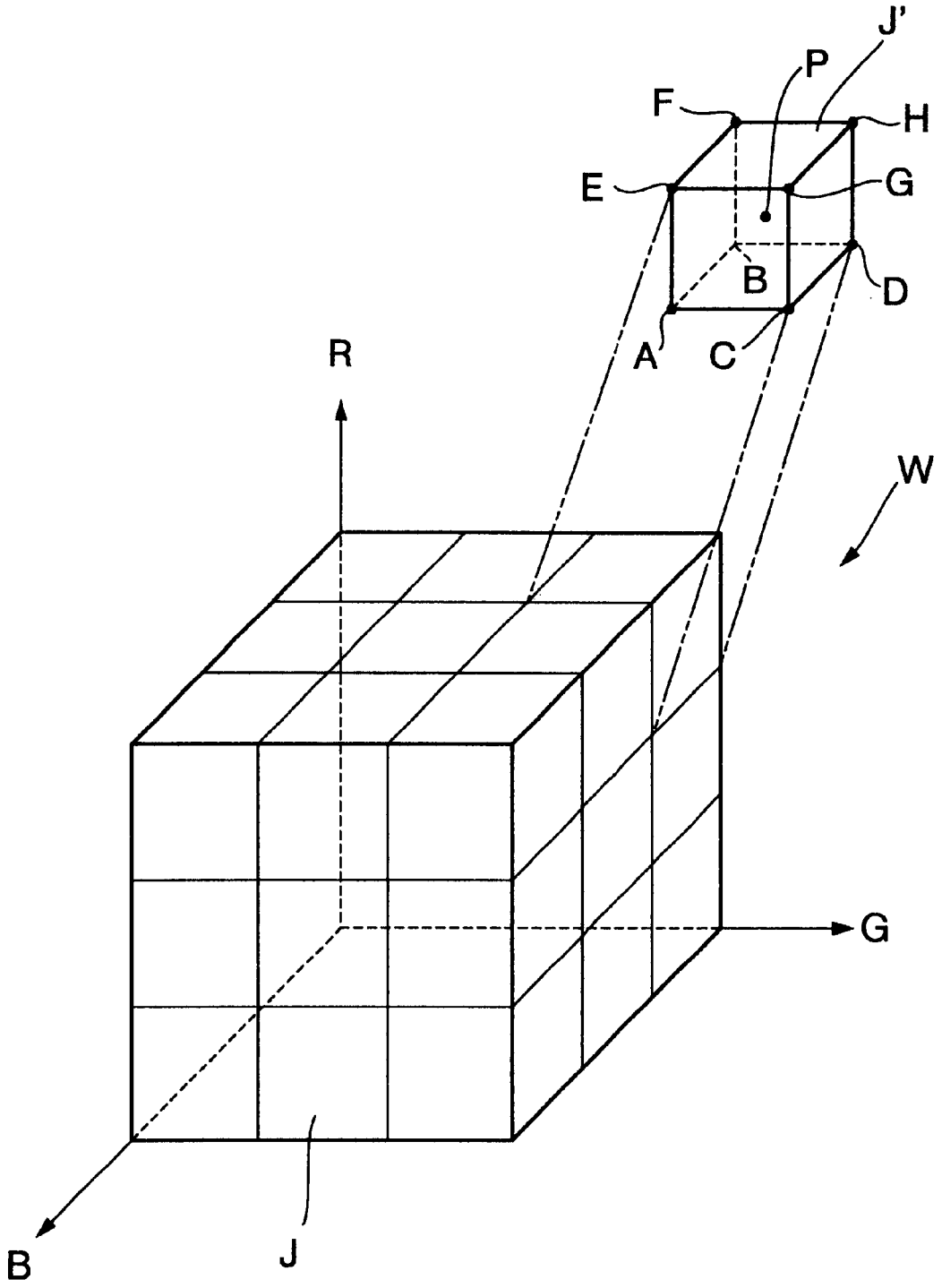
FIG. 7 shows how data is arranged in an look up table 31*a;*

It is noted that an RGB color space W is defined according to an RGB colorimetric system as shown FIG. 7. In the RGB color space W, three axes R, G, and B extend perpendicularly to one another. Along with the three axes R, G, and B, three primary color components R, G, and B of all the RGB color signals (Ri, Gi, Bi) inputtable from the scanner 28 are distributed. As shown in FIG. 7, the RGB color space W is divided by a lattice into a plurality of small cubes J. Vertex points of the plural small cubes J are arranged as a plurality of lattice points.

The LUT 31*a* stores therein a plurality of sets of RGB data (R, G, B) defined in the RGB space W as indicative of the respective lattice points. The LUT 31*a* further stores therein a plurality of Lab data sets (L, a, b) defined in a CIE-1976 L*a*b* colorimetric system. The CIE-1976 L*a*b* colorimetric system (which will be referred to simply as an Lab color system) is recommended by the Commission International de L'Eelarage (CIE). The LUT 31*a* stores the RGB data sets (R, G, B) and the Lab data sets (L, a, b) in correspondence with one another so that each Lab data set (L, a, b) represents the dame color as that represented by a corresponding RGB data set (R, G, B). The LUT 31*a* is shown in Table 3 below.

TABLE 3

| <LUT 31a> | |
|---|---|
| (R, G, B) | (L, a, b) |
| (R1, G1, B1) | (L1, a1, b1) |
| : | : |
| : | : |

Next, details of the HT-Yxt table 31*b* will be described. 31*b* stores therein: a plurality of HT chromatic color data sets H/T defined according to the above-described hue/tome colorimetric system; and a plurality of Yxy color data sets (Y, x, y) defined according to a predetermined Yxy colorimetric system so that each Yxy color data (Y, x, y) represents the same color with the corresponding HT color data set H/T. It is noted that each value H constituting each color data set H/T is defined by its representative value (5 H, for example). Each value T constituting each color data set H/T is defined by its representative pair of values V and C. This table 31*b* is produced based on Japan Industrial Standard (JIS) Z 8721 (1977). This table 31*b* is shown in Table 4 below.

TABLE 3

<Table 31b>

| H (hue) | T (tone = V / C) | Y | x | y |
|---|---|---|---|---|
| R | V | Yrv | xrv | yrv |
| | S | Yrs | xrs | yrs |
| | . . . | . . . | . . . | . . . |
| YR | V | Yyrv | xyrv | yyrv |
| | S | Yyrs | xyrs | yyrs |
| | . . . | . . . | . . . | . . . |
| . . . | . . . | . . . | . . . | . . . |

Next, details of the NV-Y table 31*c* will be described. The NV-Y table 31*c* stores therein: the plurality of achromatic NV color data sets NV, where V (vividness)=0–10, defined by the above-described hue/tome colorimetric system; and a plurality of color values Y defined according to the Yxy colorimetric system so that each color value Y represents the same color with the corresponding NV clor data. This table 31*c* is produced also based on Japan Industrial Standard (JIS) Z 8721 (1977). This table 31*c* is shown in Table 5 below.

TABLE 5

| <Table 31c> | |
|---|---|
| NV | Y |
| NO | Ymin |
| : | : |

TABLE 5-continued

| <Table 31c> | |
|---|---|
| : | : |
| N10 | Ymax |

With the above, described structue, the embroidery data editing device 10 operates as described below with referring to FIG. 9.

The CPU 20 in the computer 12 starts the processes of FIG. 9 when the power of the sewing machine 40 is turned ON while the computer 12 is in the ON condition.

When the processes of FIG. 9 are started, the CPU 20 first retrieves in S2 data of all the embroidery patterns from the embroidery card 26 now inserted in the card drive 27. Next, in S4, the CPU 20 controls the CRT 30, based on the retrieved display pattern data, to display samples of all the embroidery patterns as they will appear once sewn. The user of the embroidery data editing device 10 views the samples displayed on the CRT 30 and then operates in S6 the mouse 32 or the keyboard 33 to select one embroidery pattern desired to be sewn.

Next, the user operates the scanner 28 to scan a cloth on which the embroidery pattern selected in S6 is desired to be sewn. In S8, therefore, the CPU 20 retrieves RGB signals (Ri, Gi, Bi) outputted from the scanner 28 in the form of digital data indicative of color of the cloth. More speifically, the CPU 20 retrieves a plurality of digital data sets (Ri, Gi, Bi) from a plurality of detection (scanning) points defined over the cloth surface. Each RGB data set (Ri, Gi, Bi) is constructed from a combination of red, green, and blue color components of light retrieved from a corresponding scanning point. It is noted that each RGB data set (Ri, Gi, Bi) is temporarily stored in the RAM 24.

Then in S10, the CPU 20 produces a set of cloth data based on the plurality of digital data sets (Ri, Gi, Bi).

The cloth data can be produced in the form of a set of cloth color data (Rcloth, Gcloth, Bcloth) in a manner described below.

In order to obtain the cloth color data (Rcloth, Gcloth, Bcloth), average values Rave, Gave, and Bave are calculated for the respective color components based on the digital data sets (Ri, Gi, Bi) produced from all the detection points. The cloth color data (Rcloth, Gcloth, Bcloth) is produced in the form of the average value set (Rave, Gave, Bave).

Or, the cloth color data (Rcloth, Gcloth, Bcloth) can be produced in another manner described below.

The CPU 20 may count the number of points that present the same color indicated by the digital data (Ri, Gi, Bi). The cloth color date (Rcloth, Gcloth, Bcloth) is produced from a single color (Rmax, Gmax, Rmax) presented by the largest number of points on the cloth.

Thus, the cloth color data (Rcloth, Gcloth, Bcloth) can be produced from the average value set (Rave, Gave, Bave) for the digital data sets (Ri, Gi, Bi) of all the scanning points or from the digital data (Rmax, Gmax, Bmax) that represents the color most frequently occurring in the digital data (Ri, Gi, Bi). Thus, the cloth colot data (Rcloth, Gcloth, Bcloth) indicates a single color that represents the color state of the cloth.

When the cloth color data (Rcloth, Gcloth, Bcloth) is thus produced in S10, the program proceeds to S12. In S12, the CPU 20 stores the cloth color data (Rcloth, Gcloth, Bcloth) in the cloth data memory portion 38 prepared in the RAM 24.

Next, in S14, the CPU 20 displays a message asking the user about the impression he or she desires for the selected embroidery pattern and urging the user to input his/her desired impression. More specifically, the CPU 20 displays a message reading "Please select the image you have for this embroidery pattern." After displaying this message, the CPU 20 controls the CRT 30 to display all the plurality of sense keywords stored in the memory 34. The CRT 30 displays the plurality of sense keywords in the form selectable by the user. While viewing this display, the user operates the mouse 32 or the keyboard 33 to select one sense keyword matching the image he or she wishes for the embroidery pattern to induce in viewers of the embroidery pattern. When this selection process is completed, the program proceeds to S15.

It is now assumed that data of the flower pattern A shown in FIG. 12 is stored in the card 26 and that the user selects the pattern A in S6. When the user desires that the pattern A be sewn to induce "enjoyable" impression, the user selects the sense keyword "enjoyable" in S14.

Next, in S15, the CPU 20 resets to zero all the flags (not shown) stored in a predetermined region of the RAM 24. Those flags are provided in that region for all the sets of color combination data stored in the memory region 36 of the ROM 22.

Next, the program proceeds to S16, where the CPU 20 performs a color setting operation to set embroidery colors desirable for all of sewing regions constituting the embroidery pattern selected in S6. The CPU 20 sets the embroidery colors based on: the sense keyword selected in S14, the cloth color data (Rcloth, Gcloth, Bcloth) produced in S10, and the sense keyword data and the color combination data stored in the memories 34 and 36.

Details of the color setting operation will be described below.

First, the CPU 20 extracts, from the sense keyword memory 34, a set of sense keyword data matching the keyword set in S14. Then, the CPU 20 searches several sets of color combination data stored in the memory 36 in association with the extracted sense keyword data. The CPU 20 then performs a first selection operation onto the searched several sets of color combination data. That is, the CPU 20 selects, from the searched several sets of color combination data, one or more sets of color combination data, each of which is set with a flag of zero (0) and each of which is constructed from colors, whose total number is greater than the total number of the sewing regions in the selected embroidery pattern.

The CPU 20 then performs a second selection operation to select, from the selected one or more sets of color combination data, one color combination data set that includes a color approcimate to the cloth color indicated by the cloth color data (Rcloth, Gcloth, Bcloth).

During the second selection process, the CPU 20 performs calculation operation to judge whether each constituent color in each of the selected one or more sets of color combination data is approximate to the cloth color indicated by the cloth color data (Rcloth, Gcloth, Bcloth). This judgement is performed in a manner described below.

First, the RGB cloth color data (Rcloth, Gcloth, Bcloth), defined in the RGB colorimetric system, is converted into an Lab cloth color data (Lcloth, acloth, bcloth), defined in the Lab colorimetric system, through performing an interpolation calculation with using the LUT 31*a*.

This interpolation opertion will be described below.

Figure 8:
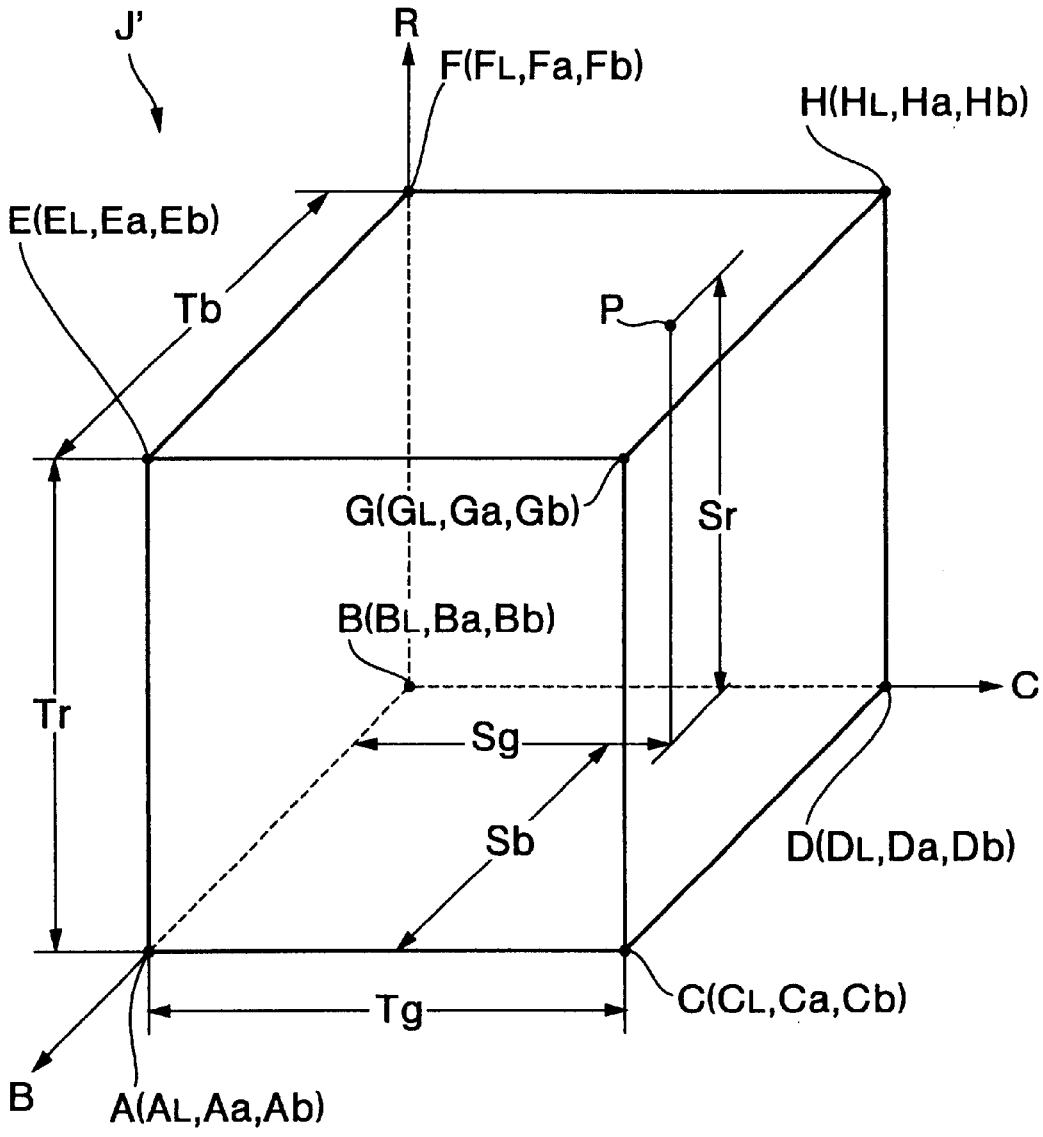
FIG. 8 illustrates an interpolation method employed for converting RGB color cloth data (Rcloth, Gcloth, Bcloth) into Lab color cloth data (Lcloth, acloth, bcloth)

As shown in FIGS. 7 and 8, a cloth color point P indicated by the RGB cloth color data set (Rcloth, Gcloth, Bcloth) resides in a specific cube J' in the RGB color space W. The cube J' is defined by eight lattice points, A, B, C, D, E, F, G, and H which surround the color point P. Accordingly, the CPU 20 selects, from the LUT 31*a*, eight sets of Lab data (L, a, b), which are stored in correspondence with RGB data sets (R, G, B) for the eight lattice points A to H. The eight sets of Lab data (L, a, b) will be respectively referred to as (AL, Aa, Ab), (BL, Ba, Bb), (CL, Ca, Cb), (DL, Da, Db), (EL, Ea, Eb), (FL, Fa, Fb), (GL, Ga, Gb), and (HL, Ha, Hb). The eight sets of RGB data (R, G, B) for the lattice points A through H will be referred to as (Ar, Ag, Ab) through (Hr, Hg, Hb), respectively.

The CPU 20 then calculates as Lab data set (Lcloth, acloth, bcloth) for the inputted cloth color data set (Rcloth, Gcloth, Bcloth) through an interpolation calculation as defined in the following formulas (1):

$$\begin{aligned}
&Lcloth=KA*AL+KB*BL+KC*CL+KD*DL+KE*EL+KP*FL+KG*GL+KH*HL\\
&acloth=KA*Aa+KB*Ba+KC*Ca+KD*Da+KE*Ea+KF*Fa+KG*Ga+KH*Ha\\
&bcloth=KA*Ab+KB*Bb+KC*Cb+KD*Db+KE*Eb+KF*Fb+KG*Gb+KH*Hb
\end{aligned} \tag{1}$$

where * indicates a multiplication, and the weight coefficients KA, KB, KC, KD, KE, KF, KG, and KH are defined in the following formulas (2):

$$\begin{aligned}
&KA=(Tr-Sr)*(Tg-Sg)*(Tb-Sb)/(Tr*Tg*Tb)\\
&KB=(Tr-Sr)*(Tg-Sg)*Sb/(Tr*Tg*Tb)\\
&KC=(Tr-Sr)*Sg*(Tb-Sb)/(Tr*Tg*Tb)\\
&KD=(Tr-Sr)*Sg*Sb/(Tr*Tg*Tb)\\
&KE=Sr*(Tg-Sg)*(Tb-Sb)/(Tr*Tg*Tb)\\
&KF=Sr*(Tg-Sg)*Sb/(Tr*Tg*Tb)\\
&KG=Sr*Sg*(Tb-Sb)/(Tr*Tg*Tb)\\
&KH=Sr*Sg*Sb/(Tr*Tg*Tb)
\end{aligned} \tag{2}$$

where Tr, Tg, Tb, Sr, Sg, and Sb represent distances defined in the following equations (3) as shown in FIG. 8.

$$\begin{aligned}
&Tr=Hr-Ar,\\
&Tg=Hg-Ag,\\
&Tb=Hb-Ab,\\
&Sr=Rcloth-Ar.\\
&Sg=Gcloth-Ag, \text{ and}\\
&Sb=Bcloth-Ab
\end{aligned} \tag{3}$$

The values Tr, Tg, and Tb are the distances between the lattice points (vertex point) on the cube J' in the R, G, and B axial directions, and the values Sr, Sg, and Sb are the distances between the color point P and the main surfaces of the cube J' in the R, G, and B zxial directions.

Thus, the RGB cloth color data set (Rcloth, Gcloth, Bcloth) is converted into the Lab cloth color data set (Lcloth, acloth, bcloth).

Next, the CPU 20 converts, into Lab data, color data COLOR (H/T or NV) of all the constituent colors in the one or more sets of color combination data selected during the first selection process. This conversion process will be described below.

First, the CPU 20 converts color data COLOR (H/T or NV) constituting each of the selected color combination data sets into a Yxy data set (Y, x, y) while referring to the HT-Yxy table 31*b* or the NV-Y table 31*c*. More specifically, when the color data COLOR is constructed from chromatic data H/T, a Yxy data set (Y, x, y) is retrieved from the HT-Yxy table 31*b* for the subject color data set H/T. When the color data is constructed from achromatic data NV, on the other hand, Y data is retrieved from the NV-Y table 31*c* for the color data NV, and a Yxy data set (Y, x, y) is determined where x=y=zero (0).

Then, each data set (Y, x, y) is converted into an Lab data set (L, a, b) through calculating the following formulas (4):

$$\begin{aligned}
&L^*=116*(Y/Yn)^{1/3}-16\\
&a^*=500*[(X/Xn)^{1/3}-(Y/Yn)^{1/3}]\\
&b^*=200*[(Y/Yn)^{1/3}-(Z/Zn)^{1/3}]
\end{aligned} \tag{4}$$

where Y=Y, Rate=Y/y, X=Rate *x, y=Rate*(1−x−y) according to Japan Industrial Standard JIS Z 8701 (1982) and where Xn, Yn, and Zn indicate tristimulas values for white color. For example, according to Japan Industrial Standard JIS Z 8719 C (1984), Xn=97,277, Yn=100, Zn =116.151 when a white color sample light source is disposed 10 nm distance. The above-described formulas (4) are described in Japan Industrial Standard JIS Z 8729 (1980).

Then, the CPU 20 calculates a color distance D between the color point P defined by the Lab cloth color data (Lcloth, acloth, bcloth) and a color point defined by the Lab color data set (L, a, b) obtained for each of the constituent colors in the color combinations selected in the first selection process. The color distance D is obtained in the Lab uniform colorimetric space through calculating the following equation (5):

$$D=[(Lcloth-L^2+(acloth-a)^2+(bcloth-b)^2]^{1/2} \tag{5}$$

The CPU 20 then compares the color distances D calculated between the cloth color and all the constituent colors of the selected color combinations. The CPU 20 then selects one color combination data whose one constituent color is located most near the cloth color. More specifically, the CPU 20 selects the smallest color distance Dmin among all the calculated color distances D. Then, the CPU 20 selects one color combination data whose constituent color is distant from the cloth color (Lcloth, acloth, bcloth) by the smallest distance Dmin.

It is noted that the CPU 20 may compare all the calculated color distances D with a predetermined threshold distance. The CPU 20 then selects one or more color combination data sets whose one constituent color is distant from the cloth color (Lcloth, acloth, bcloth) by an allowable distance smaller than the threshold. More specifically, the CPU 20 selects one or more color distances D smaller than the threshold distance. Then, the CPU 20 selects, from the one or more color combinations selected during the first selection process, one or more color combination data sets whose constituent color is distant from the cloth color by an allowable distance smaller than the threshold distance. Among the thus selected one or more selected color combination data sets, the CPU 20 selects one color combination data set.

Thus, the CPU 20 selects one color combination data set with its one constituent color being sufficiently approximate to the cloth color.

Then, colors constituting the selected color combination are determined to be used as the embroidery colors. More specifically, the color approximate to the cloth color is first removed from the colors constituting the selected color combination. Then, the remainihng colors are allotted to the sewing regions of the embroidery pattern as embroidery colors. When the total number of the colors constituting the selected color combination is greater than the total number of the sewing regions of the selected embroidery pattern by one, the number of the remaining colors is equal to the number of the sewing regions. Accordingly, all the remaining colors are allotted to the sewing regions, respectively. One the other hand, when the total number of the colors in the selected color combination is greater than the total number of the sewing regions by more than one, the number of the remaining colors is greater than the number of the sewing regions. Accordingly, some of the remaining colors are allotted to the sewing regions, respectively.

By performing these processes, the embroidery will appropriately stand out without blending in with the color of the cloth. Further, the embroidery will not result in a pattern unexpected by the user. An embroidery pattern matching the taste of the user can be easily prepared.

It is now assumed that the user selects the pattern A of FIG. 12 is S6 and the sense keyword "enjoyable" in S14. It is further assumed that the memory area 36 stores, in correspondence with the keyword "enjoyable," not only the four color combinations shown in Table 2 but also other color combinations, each being comprised of more than three colors. For example, the memory area 36 further stores, in correspondence with the keyword "enjoyable," seven color combinations (COLOR1, COLOR2, COLOR3, COLOR4), (COLOR5, COLOR6, COLOR7, COLOR8, COLOR9), (COLOR10, COLOR11, COLOR12, COLOR13, COLOR14), (COLOR15, COLOR16, COLOR17, COLOR18, COLOR19, COLOR20), (COLOR21, COLOR22, COLOR23, COLOR24, COLOR25), (COLOR26, COLOR27, COLOR28, COLOR29, COLOR30), and (COLOR31, COLOR32, COLOR33, COLOR34, COLOR35, COLOR36). Each COLORn (n=1 through 36) is indicated by H/T or NV.

The total number of the sewing regions in the pattern A is four as shown in FIGS. 13(*a*)–13(*d*). Accordingly, the CPU 20 first selects six color combination data sets (COLOR5, COLOR6, COLOR7, COLOR8, COLOR9), (COLOR10, COLOR11, COLOR12, COLOR13, COLOR14), (COLOR15, COLOR16, COLOR17, COLOR18, COLOR19, COLOR20), (COLOR21, COLOR22, COLOR23, COLOR24, COLOR25), (COLOR26, COLOR27, COLOR28, COLOR29, COLOR30), and (COLOR31, COLOR32, COLOR33, COLOR34, COLOR35, COLOR36), each data set being comprised of five or more colors and each data set being now reset with the flag of zero (0).

Then, from the selected six color combination data sets, the CPU 20 selects one color combination data set that includes one color most approximate to the cloth color. When the color indicated by COLOR15 is mast approximate to the cloth color, the CPU 20 selects the color combination (COLOR15, COLOR16, COLOR17, COLOR18, COLOR19, COLOR20). Then, the CPU 20 removes the color COLOR15 from the color combination, and further removes one color COLOR16, for example, from the color combination. The CPU 20 then allocates the remaining four clors COLOR17, COLOR18, COLOR19, COLOR20 to the sewing regions A1, A2, A3, and A4–A5, respectively.

Next, the program proceeds to S18. In S18, the CPU 20 performs display control operation based on the embroidery colors set in S16 and the embroidery data selected in S6. That is, the CRT 30 displays color sample of the embroidery pattern while showing the embroidery color set for each sewing region in S16. More specifically, the CPU 20 first produces color image data based on the display data for the selected pattern and based on the embroidery colors set in S16. The CPU 20 then controls the CRT 30 based on the thus produced color image data. Viewing the color sample, the user can easily determine whether or not the embroidery pattern is set with his/her desirable colors.

Then in S20, the CPU 20 controls the CRT 30 to display a message asking the user whether the presently-set embroidery colors are acceptable to the user or the embroidery colors should be reset into other ones.

When the user indicates in S20 that the embroidery colors should be reset to other colors (Yes in S20), then the program proceeds to S30. In S30, the CPU 20 sets, to one (1), a flag, in the RAM 24, corresponding to the present color combination data which has been selected in S16. Then, the program returns to S16, whereupon the embroidery colors are reset.

In the process of S16, one set of color combination data is selected through the first and second selection processes from color combination data sets whose correspoding flags are zero (0). Therefore, by setting to one (1) the flag for the already-selected color combination data in S30, the alredy-selected color combination data set is not used as a candidate to be selected.

In the above-described example, when the user does not wish to saw the embroidery pattern A with the color combination (COLOR15, COLOR16, COLOR17, COLOR18, COLOR19, COLOR20) (Yes in S20), the flag for that color combination data set is set to one (1) in S30. Then, in S16, the CPU 20 searches the not-yet selected color combinations stored in the memory 36 in correspondence with the keyword "enjoyable". The CPU 20 then sets one color combination data set (COLOR10, COLOR11, COLOR12, COLOR13, COLOR14) whose one constituent color COLOR13 is most approximate to the cloth color among the presently-searched colors. Then, the CPU 20 sets the remaining colors COLOR10, COLOR11, COLOR12, and COLOR14 to the sewing regions A1, A2, A3, and A4–A5, respectively.

If the embroidery colors are not to be reset (No in S20), on the other hand, then the program proceeds to S22, where an embroidery sewing operation is started based on the embroidery colors set in S16. First, in S22, th CRT 30 is controlled to display: a sewing region (first sewing region) in the embroidery pattern to be sewn first: and the name of the embroidery color set in S16 for the first sewing region. Viewing the display, the user sets an embroidery thread, of the same color as the displayed embroidery color, in the embroidery sewing machine 40. After the embroidery thread is properly set, the user manipulates the mounse 32, the keyboard 33, or some other imput device to imput an embroidery start command in S24, thereby allowing the sewing machine 40 to start embroidery processes. The sewing machine 40 performs sewing operation to sew the present sewing region based on the corresponding partial sewing data. After the present sewing region has been embroidered, then the program proceeds to S26, where the CPU 20 judges whether or not all the sewing regions of the embroidery pattern have been embroidered. If so (Yes in S26), then this series of processes is completed. Then, the processes from S1 is repeated until the sewing machine 40 is turned OFF.

If some sewing regions have not yet been sewn (No in S26), on the other hand, then the program returns to S22. In S22, the CRT 30 displays the next sewing region and its embroidery color set in S16, to thereby enable the user to set a corresponding embroidery clor thread on the sewing machine 40. Then, that sewing region is sewn in S24. Thus, a plurality of sewing regions in the embroidery pattern are successively sewn with the corresponding color threads through the repeatedly-executed processes of SS22–S26.

In the example for sewing the pattern A of FIG. 12, during the repeatedly-executed processes of S22–S26, the CRT 30 first displays the region A1 according to the display data for that region. The CRT 30 also displays the color set in S16 for the subject region A1. Viewing the CRT 30, the user sets a thread of the indicated color to the needle 142, and inputs his/her instruction to start sewing. Then, the sewing machine 40 forms stitches to fill the inside area of the region A1, with the presently-set thread, according to the partial sewing data for the region A1. Following this sewing operation (No in S26), the sewing machine 40 stops the needle 142, and the CRT 30 displays the second region A2 and the color set for that region A2. The user changes the thread with another thread of the presently-indicated color. Then, the second region A2 is sewn with the presently-set thread. Thus, the regions A1–A5 are successively sewn with threads of the set colors.

According to the above-described operation, the embroidery data editing device 10 allows wven those users without a great deal of design sense to easily prepare embroidery that achieves the impact desired by the user in accordance with the cloth on wich the embroidery is to be sewn.

It is noted that functions for achieving the above-described embroidery editing and sewing processes are stored as the computer program that is executed in the computer 12. The program is stored on the data storage medium capable of being read by the computer 12. More specifically, the program is stored in the ROM 22 capable of being read by the computer 12. The ROM 22 is installed in the computer 12. However, the program may be stored in a backup RAM (not shown) capable of being read by the computer 12. The backup RAM may be installed in the computer 12.

Or, the program may be previously stored in a data storage medium 21 such as a floppy disk, a magneto-optic disk, a CD-ROM, or the like. When required, data of the program is retrieved from the data storage medium by the operation of the external sotrage device 23 and is written into the RAM 24. Or, the program may be previously stored in a hard disk drive, and may be retrieved by the operation of the external storage device 23 and written into a working memory area prepared in the RAM 24.

Next, a second embodiment of the present invention will be explained while referring to FIGS. 10, 11, and 14–15(*b*), wherein like parts and componets of the first embodiment are designated by the same reference numerals to avoid duplicating description.

Similarly to the first embodiment, the card 26 is formed with the embroidery data memory area 25*a* for storing data of sewing regionsof the plurality of embroidery patterns as shown in Table 1. The card 26 is further formed with an embroidery color memory area 25*b* stored with data of embroidery colors that can be set for each sewing region in each of the plurality of embroidery patterns.

The ROM 22 is formed with a hemming color memory area 37. The memory area 37 stores data of a plurality of region colors. The memory area 37 further stores, in correspondence with each region color, data of at least one hemming color that can be used for separating two regions with the corresponding same region color without generating any feeling of incongruity.

The embroidery color storage area 25*b* will be described below in greater detail.

The embroidery color memory area 25*b* stores data indicative of one or more colors capable of being set for each sewing region in each embroidery pattern stored in the memory area 25*a*.

It is now assumed that the card 26 stores, in the memory area 25*a*, embroidery data for the embroidery pattern A of FIG. 12. In his case, the card 26 stores, in the memory area 25*b*, color data capable of being set for the sewing regions A1, A2, A3, and A4–15 of the embroidery pattern A as shown in Table 6 below.

TABLE 6

COLOR MEMORY AREA 25b

| sewing region | embroidery color data |
|---|---|
| A1 | 0 |
| A2 | 0 |
| A3 | GY/*, G/*, BG* |
| A4–AS | G/S, G/B, G/Dp, BG/S |

Thus, the embroidery color memory area 25*b* stores therein one or more sets of color data in association with each sewing region. Each set of color data indicates a color that can be set to the corresponding sewing region. Each color data set is defined by the hue/tone color system H/T. For example, the leaves A4 and A5 can be sewn with G/S (malachite green color), G/B (emerald green), G/Dp (deep green), or BG/S (jewel green). The asterisk symbol * used for tone T in Table 6 means that any of the tone symbols are acceptable. The stem portion A3 can therefore be sewn with green/yellow colors (GY) with any tones, green colors (G) with any tones, and blue/green colors (BG) with any tones. Color data of zero (0), stored for the sewing regions A1 and A2, means that the sewing regions A1 and A2 have no restrictions on what type of color can be set. In other words, any desired colors can be set for the sewing regions A1 and A2.

Next, the hemming color memory area 37 will be described in greater detail.

The hemming color memory area 37 stores therein all the colors (region colors) defined by all the above-described hue-indicating symbols H (R, YR, Y, GY, G, BG, B, PB, P, and RP) defined in the hue/tone color system. The memory area 37 stores, in association with each hue color (region color), at least one hemming color data representing at least one hemming color that can be used as ahem for separating two regions with the same corresponding hue (region color) without generating any feeling of incongruity. Each set of hemming color data represents a hemming color that can be positioned between two regions with the corresponding region color without arousing any sense of incongruity and that can be easily distinguished from the two regions. Each set of hemming color data is also defined by the hue-indicating symbol H (R, YR, Y, GY, G, BG, B, PB, P, or RP) or the achromatic color-indicating symbol NV.

Table 7 below shows a part of the hemming color memory area 37.

TABLE 7

HEMMING COLOR MEMORY AREA 37

| cloth/embroidery color (region color) | hemming color |
|---|---|
| R | B, G, N10, . . . |
| Y | NO, PB, B, . . . |
| G | . . . |
| YR | . . . |
| GY | . . . |
| : | : |
| : | : |

As apparent from Table 7, the memory area 37 stores, for each region color, one or more hemming colors which should be used for hemming a sewing region of the each region color when the sewing region is directly contacted with the background region (cloth) of the same or similar color. For example, hemming colors of blue (B), green (G), white (N10), etc. can be used for hemming a red color region (R) on the red color cloth (R).

It is noted that in the above-described example of Table 7, the plurality of region colors are categorized only by hue (H=R, Y, . . . ). However, the region colors can be categorized further by tones (T=V, S, . . . ). Similarly, in the above-described example of Table 7, the plurality of hemming colors are categorized only by hue (H=R, Y, . . . ) or achromatic color-indicating symbol NV. However, the hemming colors can be categorized further by tones (T=V, S, . . . ).

With the above-described structure, the embroidery data editing device 10 of the present embodiment operates as described below while referring to FIG. 11.

Figure 11:
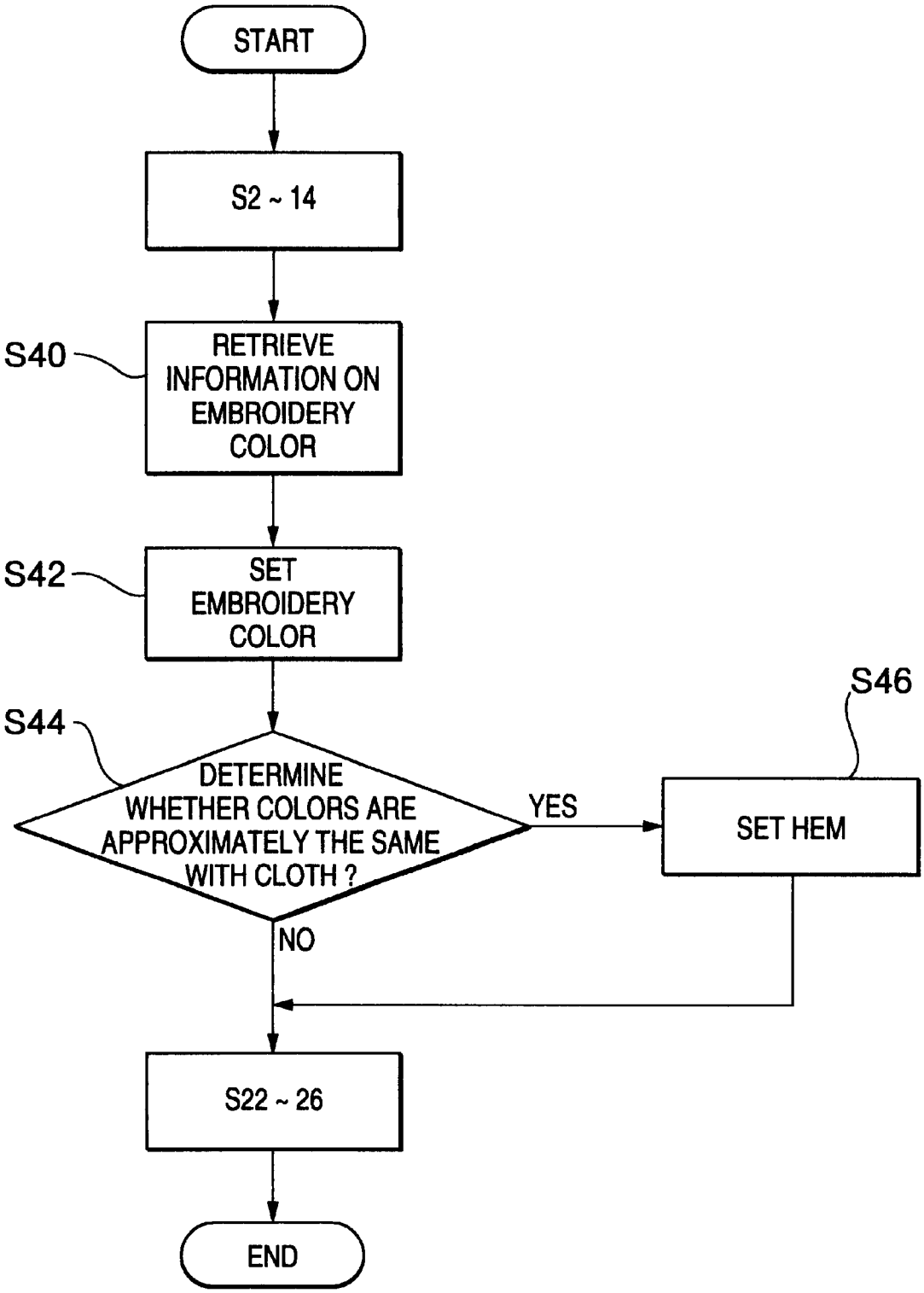
FIG. 11 is a flowchart illustrating operation of the embroidery data editing device of the second embodiment.

It should be noted that S2 to S14 in the flowchart shown in FIG. 11 are the same as the processes of S2 to S14 in the first embodiment of FIG. 9. Accordingly, explanation of these steps will be omitted.

When the sewing machine 40 is turned ON, the processes of S2 to S14 shown in FIG. 11 are executed in the same manner as in the first embodiment. As a result, data for the user's selected embroidery pattern is retrieved from the card 26, cloth data (Rcloth, Gcloth, Bcloth) is produced, and a sense keyword indicative of the user's desired impression is inputted.

Then, the program proceeds to S40, where the CPU 20 retrieves, from the memory area 25*b* of the card 26, color data indicative of one or more colors selectable for each of the constituent sewing regions of the selected embroidery pattern. The CPU 20 then stores the retrieved color data (selectable color data) into a predetermined region (not shown) of the RAM 24.

It is now assumed that the user has selected in S6 the flow embroidery pattern A of FIG. 12. In this case, the CPU 230 retrieves, from the memory area 25*b,* all the selectable colors shown in Table 6, and stores them in the RAM 24.

Next, in S42, the CPU 20 sets an embroidery color for each sewing region based on: the selectable color data presently stored in the RAM 24: and the cloth data (Rcloth, Gcloth, Bcloth) and the sense keyword data which have been set in S2 through S14.

It should be noted that the processes executed in S42 are similar to those performed in S16 of the first embodiment except that one color combination is selected from the color combination data memory area 36 not only based on the sense keyword and the cloth data but also based on the selectable color data. That is, one color combination is selected so as to correspond to the inputted sense keyword, so as to include one or more colors, the total number of which is greater than the number of the constituent sewing regions of the selected pattern, so as to include a color the same as or similar to the cloth color, and so as to include, for each constituent sewing region, at least one color indicated by the selectable color data set for the subject sewing region.

In order to perform this selection operation, the CPU 20 performs as described below.

First, the CPU 20 extracts, from the sense keyword memory 34, a set of sense keyword data matching the keyword set in S14. Then, the CPU 20 searches several sets of color combination data stored in the memory 36 in association with the extracted sense keyword data. The CPU 20 then performs the first selection operation onto the searched several sets of color combination data. That is, the CPU 20 selects, from the searched several sets of color combination data, one or more sets of color combination data, each of which is set with a flag of zero (0), and each of which is constructed from colors whose total number is greater than the total number of the sewing regions in the selected embroidery pattern. The above-described first selection processes are the same as the first selection processes performed in S16 of the first embodiment. According to the present embodiment, the CPU 20 then selects, from the thus selected color combination data sets, one or more sets of color combination data in accordance with the contents of the memory area 25*b*. That is, the CPU 20 selects one or more sets of color combination data, each set including at least one selectable color for each sewing region of the selected embroidery pattern. For example, when the user has selected the embroidery pattern A of FIG. 12, the CPU 20 selects one or more sets of color combination data, each set including at least one of the selectable colors GY, G, and BG and at least one of the selectable colors G/S, G/B, G/Dp, and BG/S. The CPU 20 thus selects one or more sets of color combination data usable for the present embroidery pattern.

After this selection operation, the CPU 20 performs the second selection operation to select, from the usable one or more sets of color combination data, one color combination data set that includes a color most approximate to the cloth color indicated by the cloth color data (Rcloth, Gcloth, Bcloth). Then, the CPU 20 allocates constituent colors of the selected color combination to the sewing regions of the selected embroidery pattern.

It is now assumed that the user has selected the flower embroidery pattern A of FIG. 12 and has inputted a sense keyword "enjoyable" in S14. In this case, the CPU 20 selects one color combination that corresponds to the sense keyword "enjoyable," that includes five or more colors, that includes a color the same as or similar to the cloth color, and that further includes at least one of the selectable colors GY/*, G/*, and BG/* and at least one of the selectable colors G/S, G/B, G/Dp, and BG/S. It is also assumed that color data COLOR23 is G/V and color data COLOR24 is G/B, and that color data COLOR28 is BG/V and color data COLOR29 is G/Dp. In this case two color combination data sets (COLOR21, COLOR22, COLOR23, COLOR24, COLOR25) and (COLOR26, COLOR27, COLOR28, COLOR29, COLOR30) are selected as usable for the present embroidery pattern. If color data COLOR21 of the color combination (COLOR21, COLOR22, COLOR23, COLOR24, COLOR25) is most approximate to the cloth color among the colors COLOR21–COLOR30, the color combination data (COLOR2, COLOR22, COLOR23, COLOR24, COLOR25) is finally selected. The color data COLOR23 is set to the sewing region A3, the color data COLOR24 is set to the sewing region A4–A5, and the remaining color data COLOR22 and COLOR 25 (other than the COLOR21 similar to the cloth color) are set to the regions A2 and A2, respectively.

When one color combination is thus set and its constituent colors are set to the respective sewing regions of the embroidery pattern in S42, the program proceeds to S44.

It is noted that the thus set color combination may possibly include two or more similar colors. One of the two similar colors may possibly correspond to color data stored in the memory 25*b* as selectable for some sewing region bordering on the cloth. The other remaining color may possibly correspond to the cloth color. In this case, the bordering sewing region is set with the color similar to the cloth color. When the bordering sewing region were sewn with the color similar to the cloth, the color of the sewing region will blend in with the color of the cloth so that the sewing region will be difficult to perceive.

In order to solve this problem, the judgment process of S44 is attained. In S44, the CPU 20 judges how similar the cloth color is to the embroidery color which has been set in S42 for each of at least one sewing region bordering on the cloth. In the example where the flower pattern A has been selected, the CPU 20 judges how similar the cloth color is to: the color data COLOR23 set to the sewing region A3, the color data COLOR24 set to the sewing region A4–A5, and the color data COLOR 25 set to the region A2.

This judgment process will be described below in greater detail.

First, the CPU 20 selects at least one sewing region bordering on the cloth. In the above-described example, the CPU 20 selects the sewing regions A2, A3, and A4–A5. The CPU 20 then converts the cloth color data (Rcloth, Gcloth, Bcloth), which has been produced in S10, into a set of Lab cloth color data (Lcloth, acloth, bcloth) through performing the interpolation calculation with using the LUT31*a* in the same manner as in S16 of the first embodiment.

Then, the CPU 20 converts embroidery color data COLOR (H/T or NV), which has been set in S42 for each bordering sewing region, into a set of Lab border color data set (L, a, b) through using the HT-Yxy conversion table 31*b* and the NV-Y conversion table 31*c* and through calculating the formulas (4) also in the same manner as in S16 of the first embodiment. In this example, the color data COLOR23, COLOR24, and COLOR25 are converted into Lab border color data sets (L23, a23, b23), (L24, a24, b24), and (L25, a25, b25), respectively.

The CPU 20 then calculates a color distance D between each border color data (L, a, b) and the cloth color data (Lcloth, acloth, bcloth) through calculating the formula (5). In this example, the CPU 20 calculates a color distance D between each of the border color data (L23, a23, b23), (L24, a24, b24), and (L25, a25, b25) and the cloth color data (Lcloth, acloth, bcloth). The CPU 20 judges whether or not the amount of each calculated color distance D is equal to or less than a predetermined threshold value.

When it is determined that the color distance D is equal to or less than the predetermined threshold at some bordering sewing region, this means that the bordering color region is being set with a color sufficiently approximate to the cloth color. As a result, the judgment of S44 becomes affirmative (Yes in S44), and the program proceeds to S46.

In S46, the CPU 20 first searches one or more sets of hemming color data which are stored in the memory area 37 in correspondence with the color indicated by the cloth data. Then, the CPU 20 extracts a single desired color from the searched one or more hemming colors, and sets the extracted color for hemming the bordering sewing region.

In this example, it is now assumed that the color data COLOR23 (i.e., (L23, a23, b23)) or G/V and COLOR24 (i.e., (L24, a24, b24)) or G/B are both determined as approximate to the cloth color (Lcloth, acloth, bcloth) of green color. In this case, one hemming color is extracted from one or more hemming colors which are stored in the memory 37 in correspondence with the green color "G" as shown in Table 7. The extracted one hemming color is set for hemming the regions A3 and A4–A5.

It is desirable that in S46 the selected hemming color data be displayed on the CRT 30 as a preview so that the user can observe the preview and more easily determine whether or not he or she wishes to select a different hemming color. When the user does not wish to sew the bordering sewing regions with the displayed hemming color, the user may input his/her instruction to select another hemming color.

Or, the process of S46 may be designed to select the hemming color according to the user's inputted sense keyword so that the hemming color can provide a color combination that matches the user's sense.

After one hemming color is thus set, the CPU 20 then produces hemming sewing data for sewing a hem at an outer rim of the subject bordering sewing region with the selected hemming color. The hemming sewing data is added to the partial sewing data for the subject bordering sewing region at its outer rim. In this example, hemming sewing data is added to the partial sewing data for the sewing regions A3 and A4–A5.

In order to produce the hemming sewing data, the CPU first retrieves, from the memory area 25*a*, outline data indicative of the contour of the subject bordering sewing region (sewing regions A3 and A4–A5 in this example). The CPU then produces a plurality of sets of stitch-position data (hemming sewing data) representing stitch positions located on both sides of the outline to thereby form zigzag stitches along the outline of the subject sewing region as a reference line. Other than zigzag-stitch sewing, single-, double-, or triple-stitch sewing, or E-stitch sewing may be employed to embroider the outline. Other various manners for producing the hemming sewing data can be employed.

Thus, the CPU 20 produces hemming data for all the bordering sewing regions (sewing regions A3 and A4–A5, in this example) set with colors approximate to the cloth color.

Then, the program proceeds to start executing the processes of S22–S26. The processes of S22–S26 according to the present embodiment are the same as those of the first embodiment except that hemming is sewn in addition to the inside of the sewing regions.

The routines of S22–S26 according to the present embodiment will be described below.

First, in S22, the CRT 30 is controlled to display: a sewing region to be sewn in the present routine; and the name of the embroidery color set for the present sewing region. Viewing the display, the user sets an embroidery thread, of the same color as the displayed embroidery color, in the embroidery sewing machine 40. The sewing machine 40 performs sewing operation in S24 to sew the inside area of the present sewing region. After the present sewing region has been embroidered, then the program proceeds to S26, where the CPU 20 judges whether or not all the sewing data and all the hemming sewing data have been sewn for the present embroidery pattern. If some sewing regions or some hems have not yet been sewn (No in S26), the program returns to S22. When the sewing region sewn in the latest routine of S24 has been added with hemming sewing data, the CRT 30 displays in the present process of S22 hemming color set for that sewing region while continuously displaying that sewing region. The user sets a corresponding embroidery color thread on the sewing machine 40, and the outer rim of the sewing region is sewn in S24 according to the hemming data. During the next routine of S22–S26, the next sewing region is sewn.

Thus, a plurality of sewing regions and their outer rims are successively sewn with the corresponding color threads through the repeatedly-executed processes of S22–S26.

In the example for sewing the pattern A of FIG. 12 while hemming the regions A3 and A4–A5, the regions A1, A2, and A3 are sewn in the same manner as in the first embodiment. After the sewing region A3 is sewn, the CRT 30 displays in S22 the name of the hemming color set in S46 while continuing displaying the sewing region A3. Then, the hems of the sewing region A3 are sewn in S24. Then, after displaying in S22 the sewing region A4–A5 and the name of the color set for that sewing region, the inside area of the sewing region A4–A5 is sewn with the set color in S24. Then, again, in S22, the name of the hemming color set for the sewing region A4–A5 is displayed together with sewing region A4–A5. Then, the hems of the sewing region A4–A5 are sewn in S24. Thus, the sewing regions A1–A5 and hems for the sewing regions A3 and A4–A5 are sewn with threads of the set colors.

On the other hand, if colors of all the bordering regions are sufficiently different from the cloth color (No in S44), then this series of operations is ended, and the program directly proceeds to the embroidery sewing processes of S22–S26. In this case, the sewing regions are successively sewn in the same manner as in the first embodiment.

As described above, according to the present embodiment, the selectable color data is previously set in the card 26. This insures that the user will set only colors desirable for the sewing regions. This is important in situations wherein use of other than a particular color, such as blue for the sky and sea and green for leaves of plants, will degrade the appearance of the embroidery pattern. For example, incongruous use of colors, such as green for faces or yellow for oceans, can be prevented.

Figure 15A:
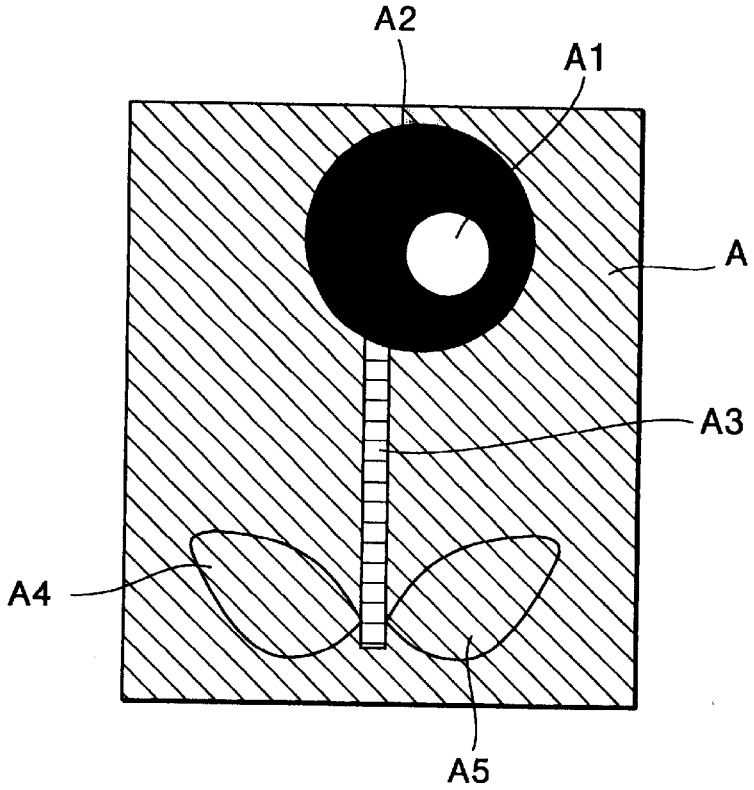
FIG. 15(*a*) illustrates the embroidery pattern of FIG. 12 when color approximate to the cloth color has to be set to the sewing regions of FIGS. 13(*c*) and 13(*d*)
Figure 15B:
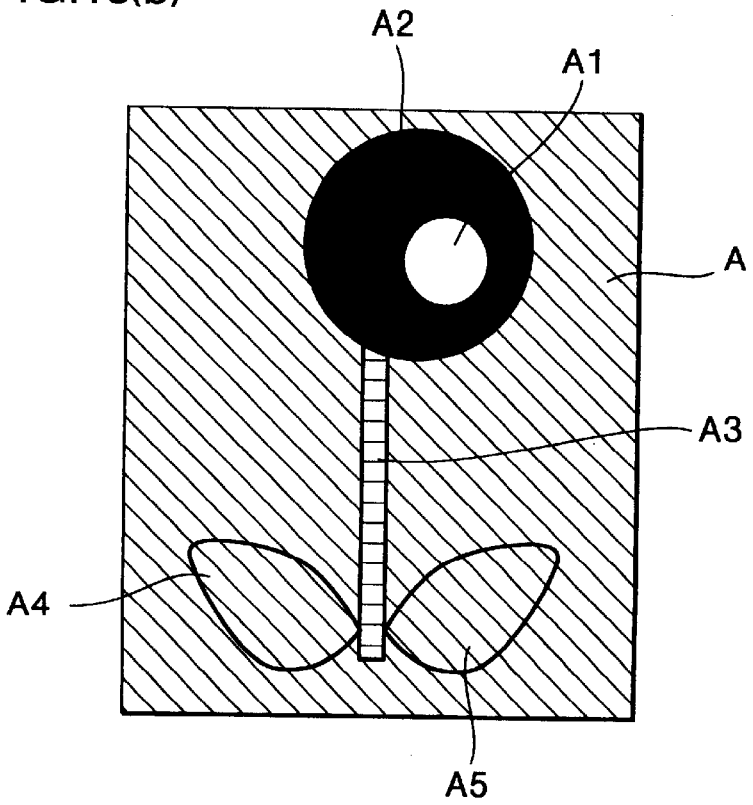

FIG. 15(*a*) shows an exemplary case where the embroidery pattern A is sewn on a green cloth based on sewing data whose sewing regions A3–A5 are restricted to be sewn with green colors as shown in Table 6. In this case, the green-colored leaves A4 and A5 and stem A3 do not clearly show up against the green color of the cloth so that the embroidery pattern A seems to include the flower head itself only as shown in FIG. 15(*a*).

According to the present embodiment, in this case, the judgment process of S44 determines that green color data set for the bordering sewing regions A3–A5 are similar to the green cloth color data ("Yes" in S44). Accordingly, in S46, embroidery data for the bordering sewing regions is modified to be added with hemming embroidery data around those sewing regions. Therefore, as shown in FIG. 15(*b*), the stem and leaves become easier to see. Also, the hem is set with a desirable color according to the hemming color data stored in the memory area 37. Accordingly, the entire embroidery pattern can be produced to be easily discerned and to have a desirable color combination.

Thus, as described above, according to the first and second embodiments, the memory 36 previously stores therein a plurality of sets of color combination data indicative of a plurality of desirable combinations of colors. The color of the cloth to be sewn is read by the scanner 28. With referring to the memory 36, the device can select one combination of colors suited for the color of the cloth. The device displays the selected color combination so that the user can confirm the selected color combination.

Especially, according to the second embodiment, color of each sewing region is limited to certain colors as stored in the memory 37. Hemming embroidery data is added to the embroidery data at an outer rim of the embroidery pattern if needed.

As described above, according to the above-described embodiments, the embroidery data editing device 10 can edit embroidery data to be used in the embroidery sewing machine 40 which is capable of sewing embroidery. The embroidery data editing device 10 is mounted with the embroidery card 26 which stores therein data indicative of each of at least one sewing region constituting an embroidery and indicative of stitches to be sewn in each sewing region. Each sewing region is defined as a region to be sewn with a single color. The embroidery data editing device 10 is further provided with the RAM 24 for temporarily storing cloth data indicative of color of cloth to be sewn with the embroidery. The device 10 is provided with the memory 36 previously storing therein a plurality of sets of color combination data indicative of a plurality of desirable color combinations. The device 10 performs an operation to set an embroidery color for each sewing region, indicated by the sewing region data, in the embroidery to be sewn. The device 10 performs this setting operation based on the color combination data and on the cloth data.

With this structure, the embroidery data editing device 10 can extract a color combination, inclusive of the color of the cloth, from the plurality of desirable color combinations. Then, colors constituting the color combination other than the cloth color are allocated to the respective sewing regions. Accordingly, the sewing regions of the embroidery pattern are set with colors that can provide a proper color combination with the cloth color. With this device, anybody can easily prepare embroidery patterns with suitable colors, without paying too much attention to the color of cloth on which the pattern is to be sewn.

The embroidery data edit device 10 is provided with the scanner 28 for inputting, in the form of digital data, information on color of the cloth to be sewn. The CPU 20 produces cloth data based on the digital data inputted from the scanner 28. With this configuration, the device 10 can receive digital data representing color of the cloth. Further, the device 10 prepares cloth data based on the inputted digital data. Therefore, the device 10 can produce the embroidery pattern with a suitable color combination on his/her desired cloth even when data of that cloth is not prestored in the device 10.

The embroidery data editing device 10 is further provided with the memory 34 for storing data of the plurality of sense keywords each in corresponding with at least one set of color combination data stored in the memory 36. Each sense keyword represents a sensation to be evoked in individuals who view at least one color combination indicated by the corresponding at least one set of color combination data. The memory 36 stores the plurality of sets of color combination data so that one or more sets of color combination data, whose corresponding color combinations can give the same sensation to viewers, are stored in one group. Each group constructed from the one or more color combination data sets is stored in association with one sense keyword, stored in the memory 34, indicative of the corresponding sensation. The device 10 is designed to enable the user to input his/her desired sensation information for the embroidery to be sewn. The device 10 sets embroidery colors for the sewing regions of the embroidery pattern based on the sense keyword data stored in the memory 34 and on the sensation information inputted by the user.

With this configuration, the user inputs a sense he or she desires for the embroidery pattern to evoke in viewers of the embroidery pattern. The device 10 sets embroidery colors for the respective sewing regions based on the sense keyword and the inputted user's desired information. More specifically, the embroidery data editing device 10 determines one sense keyword that properly indicates the sensation the user desires for the embroidery to evoke in a viewer. The device 10 then sets colors for the respective sewing regions based on the cloth color and one of the color combinations stored in correspondence with the determined sense keyword. Therefore, the embroidery pattern will be sewn with threads of colors matching the cloth and the taste of the user. Because the device 10 prepares embroidery data matching the sensation that the user desires to evoke, the device can prepare embroidery patterns more acceptable to the user's own taste.

Before finally setting the embroidery colors, the device 10 prepares image data based on the set embroidery colors and on the sewing region data (display data) for each sewing region stored in the card 25. The CRT 30 displays an image of the entire embroidery pattern based on the image data. In this way, the CRT 30 displays a sample of the embroidery pattern to show how the embroidery pattern would appear with sewing regions being sewn according to the sewing region data and presently-set colors. Therefore, the user can gain a good appreciation of the final embroidery pattern merely by viewing the display. This enables the user to easily judge whether the embroidery pattern can be suitably prepared.

According to the present embodiments, the keyboard 33 and the mouse 32 are provided to enable the user to input information indicative of the user's desire. The device can determine whether or not the user's inputted information is a request to reset embroidery color combination. When the device 10 determines that the inputted information is a request to reset embroidery color combination, then the device 10 performs resetting operation to reset the embroidery color combination to a different combination than the previously set combination.

In this way, the user can freely select colors of the embroidery threads set by the device 10. When the user determines not to select the device's set colors, the device 10 performs the resetting operation to provide candidates for new and desirable embroidery thread colors so that the user can easily select his/her desirable embroidery colors.

Especially, according to the second embodiment, the device 10 sets embroidery colors further taking into account embroidery color characteristic data stored in the embroidery color memory 25*b* of the card 26. The embroidery color characteristic data is preset for each sewing region. The embroidery color characteristic data indicates that some sewing region should be set to one or more colors specific to the sewing region. When some sewing region in the embroidery pattern is set in a color that should not be changed according to the embroidery color characteristic data, the device can maintain that color for the subject sewing region. The device can provide desired restrictions on colors, with which the sewing region can be set. The device can therefore prepare an embroidery pattern that matches the sense and taste of the user and still that is appropriate.

The device 10 is further designed to judge whether or not a cloth color is approximately the same as the embroidery color set for each sewing region bordering the embroidery pattern. Based on the judged results, the device 10 changes the embroidery data at the outer rim of the bordering sewing region. More specifically, when the embroidery color and the cloth color are nearly the same, then the device 10 modifies the embroidery data for facilitating distinction between cloth color and the embroidery color. Therefore, the embroidery pattern can be prepared more easily discernible. In the above-described embodiment, new hemming is formed around the bordering sewing region of the color approximately the same as the cloth color. Therefore, even if the embroidery color and the cloth color are approximately the same, both regions can be properly discernible so that the embroidery color itself can be prepared to be more easily discernible.

While the invention has been described in detail with reference to the specific embodiments thereof, it would be apparent to those skilled in the art that various changes and modifications may be made therein without departing from the spirit of the invention.

For example, in the above-described embodiments, the cloth data is produced in S10 in the form of the set of cloth color data (Rcloth, Gcloth, Bcloth) based on the color data (Ri, Gi, Bi) retrieved in S8. The cloth color data (Rcloth, Gcloth, Bcloth) is indicative of a single color representing the optical state of the cloth. However, the cloth data can be produced in the form of pattern pitch data in a manner described below.

In S10, the CPU 20 may judge whether or not periodic fluctuation exists in the plurality of digital data sets (Ri, Gi, Bi) supplied from the scanner 28. The CPU 20 determines that a certain pattern or texture appears periodically on the cloth when some periodic fluctuation exists in the digital data. The CPU 20 then determines an interval of the fractuation as the pattern pitch data.

In the above-described embodiments, colors of the embroider pattern are set to express the user's desired sense of the embroidery. However, other various states (sewing conditions) of the embroidery can be used to express the user's desired sense of the embroidery. For example, sense can be expressed by the size of the embroidery pattern. When the cloth has a checked pattern or other periodically repeating pattern, the scanner 28 and the CPU 20 cooperate to produce the periodic pitch data. With using the periodic pitch data, the CPU 20 may adjust the size of the embroidery pattern in correspondence with the dimension of the periodic pitch.

More specifically, when the size of the embroidery is almost equal to the pitch of the periodically repeating pattern on the cloth, the embroidery pattern will blend into the pattern of the cloth and so will not sufficiently stand out. Accordingly, when the size of the embroidery pattern is almost equal to the distance or interval between the repeating patterns, then the CPU 20 changes the size of the embroidery pattern and produces embroidery data thus edited in accordance with the cloth characteristics.

In this case, the memory 36 may previously store a plurality of magnification/reduction rates for changing the size of the embroidery pattern. The memory 34 may previously store a plurality of sense keywords, such as "mild" and "dynamic," in accordance with the magnification/reduction rates. For example, the sense keyword "mild" is stored in correspondence with a reduction rate or a small magnification rate as small as ten (10) percents. The sense keyword "dynamic" is stored in correspondence with a larger magnification rate over 200 percents.

With this structure, when the user selects a sense keyword "mild" in S14, the size of the embroidery pattern is reduced or enlarged by the slight magnification rate as small as ten (10) percents in S16. When the sense keyword "dynamic" is selected in S14, on the other hand, the size of the embroidery pattern is enlarged over two times in S16. The resultant embroidery pattern may be shown on the CRT 30 in S18 so that the user can set a desired magnification rate through manipulating the mouse 32 or the like.

The present invention is thus applied to perform various changes onto embroidery data in accordance with both cloth data indicative of characteristic of the cloth to be sewn and the sense keyword expressing the user's desired impression. Therefore, the present invention can be applied to change of sewing states (sewing conditions) of the embroidery pattern other than color of the embroidery pattern. That is, the setting process of S16 is designed to set some sewing condition of the embroidery pattern, such as the embroidery pattern size or the colors, based on both the cloth data indicative of the cloth to be sewn and the sense keyword inputted in S14. The process of S18 is designed to show the embroidery pattern at the presently-set sewing condition. Through the judgment process of S20, the sewing condition of the embroidery pattern is repeatedly reset in order to match the user's taste.

In the above-described embodiments, cloth data is inputted from the scanner 28 to the computer 12. However, cloth data of a plurality of predetermined kinds of clothes can be previously stored in the ROM 22. When one of the predetermined clothes is desired to be sewn with some embroidery pattern, the user inputs information on the cloth, whereupon the CPU 20 extracts the cloth data of that cloth from the ROM 22.

In the above-described embodiments, a desirable color combination is selected according to the cloth color data (Rcloth, Gcloth, Bcloth) of the cloth and according to the user'inputted sensation desired to be given onto his/her selected embroidery pattern. However, the desirable color combination may be selected according to other color characteristics of the cloth, such as the pattern (color changing state) of the cloth. For example, the desirable color combination may be selected according to the pattern pitch data of the cloth and according to the user's inputted sensation desired to be given onto his/her selected embroidery pattern.

According to this modification, the pattern pitch data is calculated in S10. In S16, one desirable color combination is selected according to the pattern pitch data and according to the sense keyword inputted in S14 in a manner described below.

It is noted that because the pattern pitch data can be produced in S10, the CPU 20 determines that the cloth has more than one colors for representing the pattern that periodically appears on the cloth at the determined pattern pitch. Accordingly, the CPU 20 determines more than one set of cloth pattern color data (Rcp, Gcp, Bcp) based on the plurality of sets of RGB color data (Ri, Gi, Bi), which have been supplied from the scanner 28 in S8. The CPU 20 then determines the size of the embroidery pattern selected in S6 based on the embroidery data stored in the card 26. The CPU 20 compares the size of the embroidery pattern with the pitch of the cloth pattern which is determined by the pattern pitch data.

When the cloth pattern pitch is considerably smaller than the embroidery pattern size, the CPU 20 calculates an average color data set (Rave, Gave, and Bave) as an average data for the more than one sets of cloth pattern color data (Rcp, Gcp, Bcp). The CPU 20 determines the thus calculated average color data step (Rave, Gave, and Bave) as the cloth color data (Rcloth, Gcloth, Bcloth). Then, the CPU 20 selects one color combination in the same manner as in the first embodiment based on the thus obtained cloth color data (Rcloth, Gcloth, Bcloth) and the user's inputted sense keyword.

When the cloth pattern pitch is not considerably smaller than the embroidery pattern size, on the other hand, the CPU 20 sets the already-determined more than one cloth pattern cloth sets (Rcp, Gcp, Bcp) as more than one sets of cloth color data (Rcloth, Gcloth, Bcloth). Then, the CPU 20 selects one color combination that corresponds to the user's inputted sense keyword and that includes one or more color, each of which is similar to the more than one cloth color (Rcloth, Gcloth, Bcloth). In order to set embroidery colors for the sewing regions of the embroidery pattern, the CPU 20 first removes, from the selected color combination, the one or more color similar to the more than one cloth colors. Then, the CPU 20 allocates the remaining colors to the respective sewing regions of the embroidery pattern.

Figure 1:
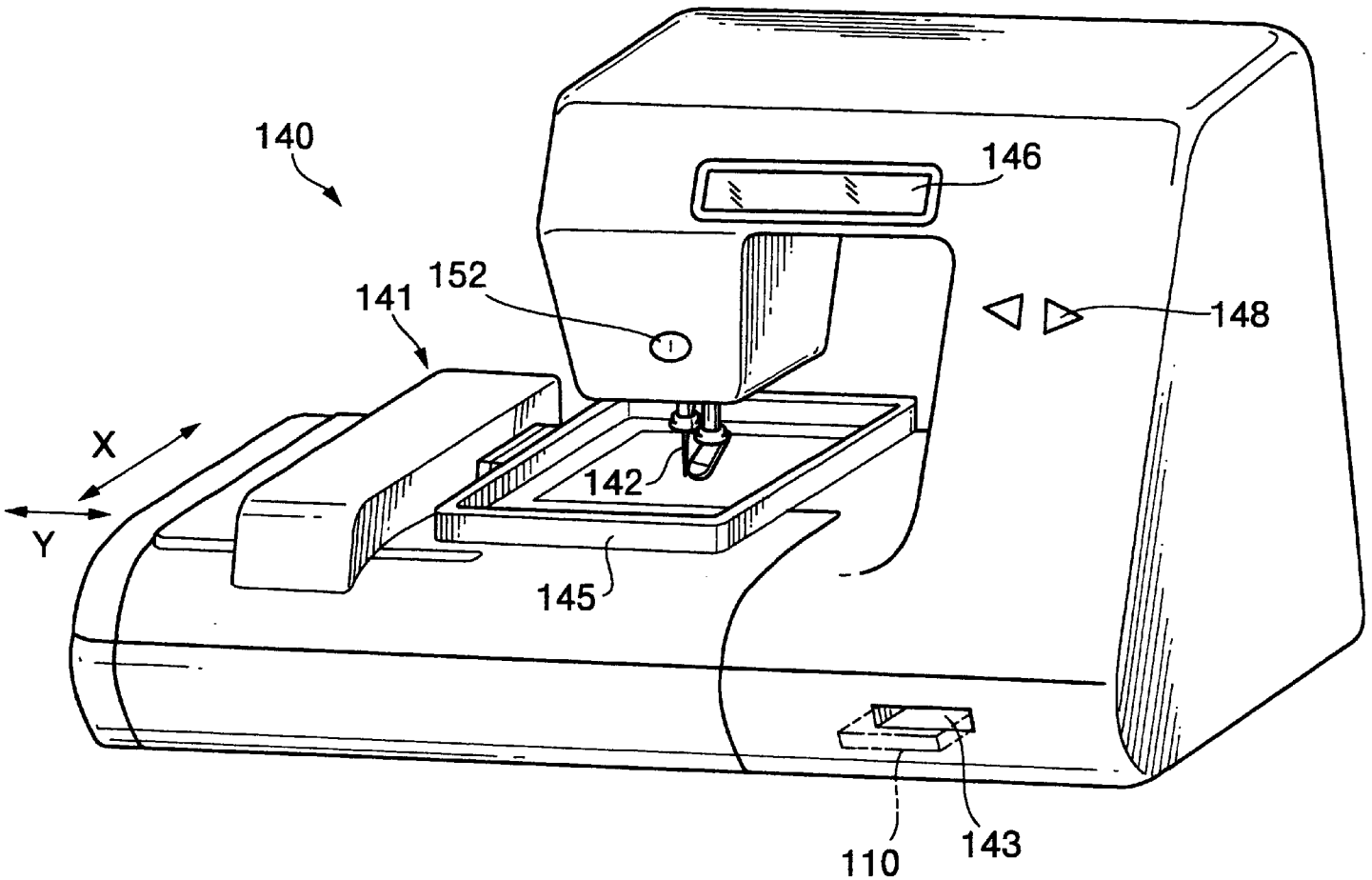
FIG. 1 is a perspective view showing a conceivable sewing machine.
Figure 2:
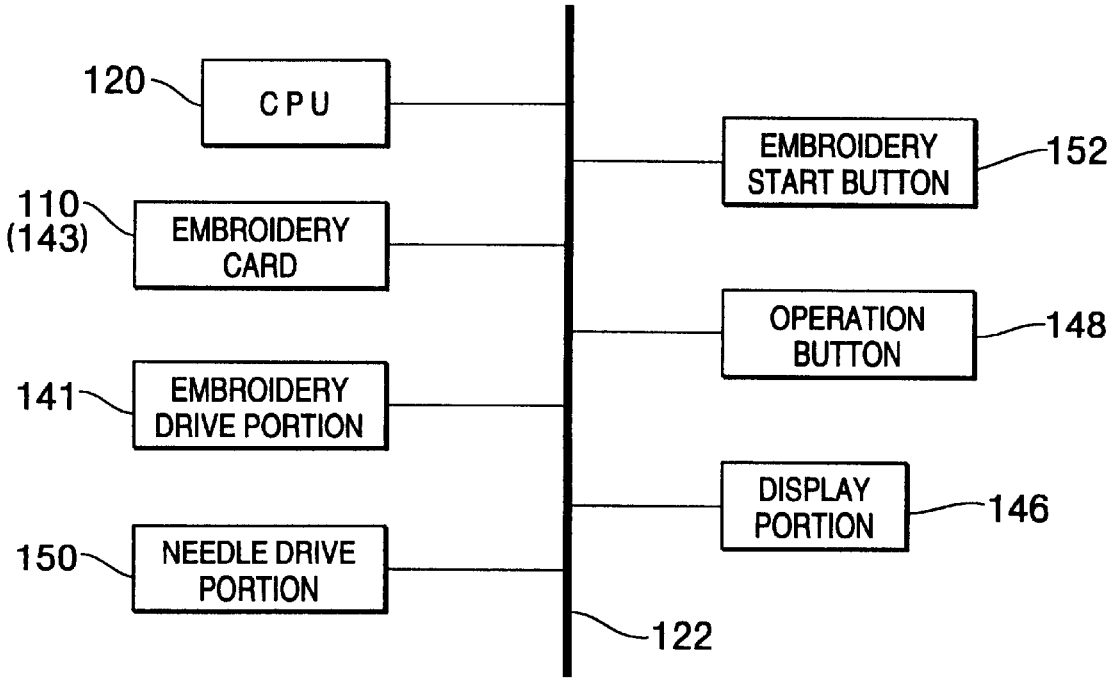
FIG. 2 is a block diagram of a control structure of the conceivable sewing machine of FIG. 1.
Figure 3:
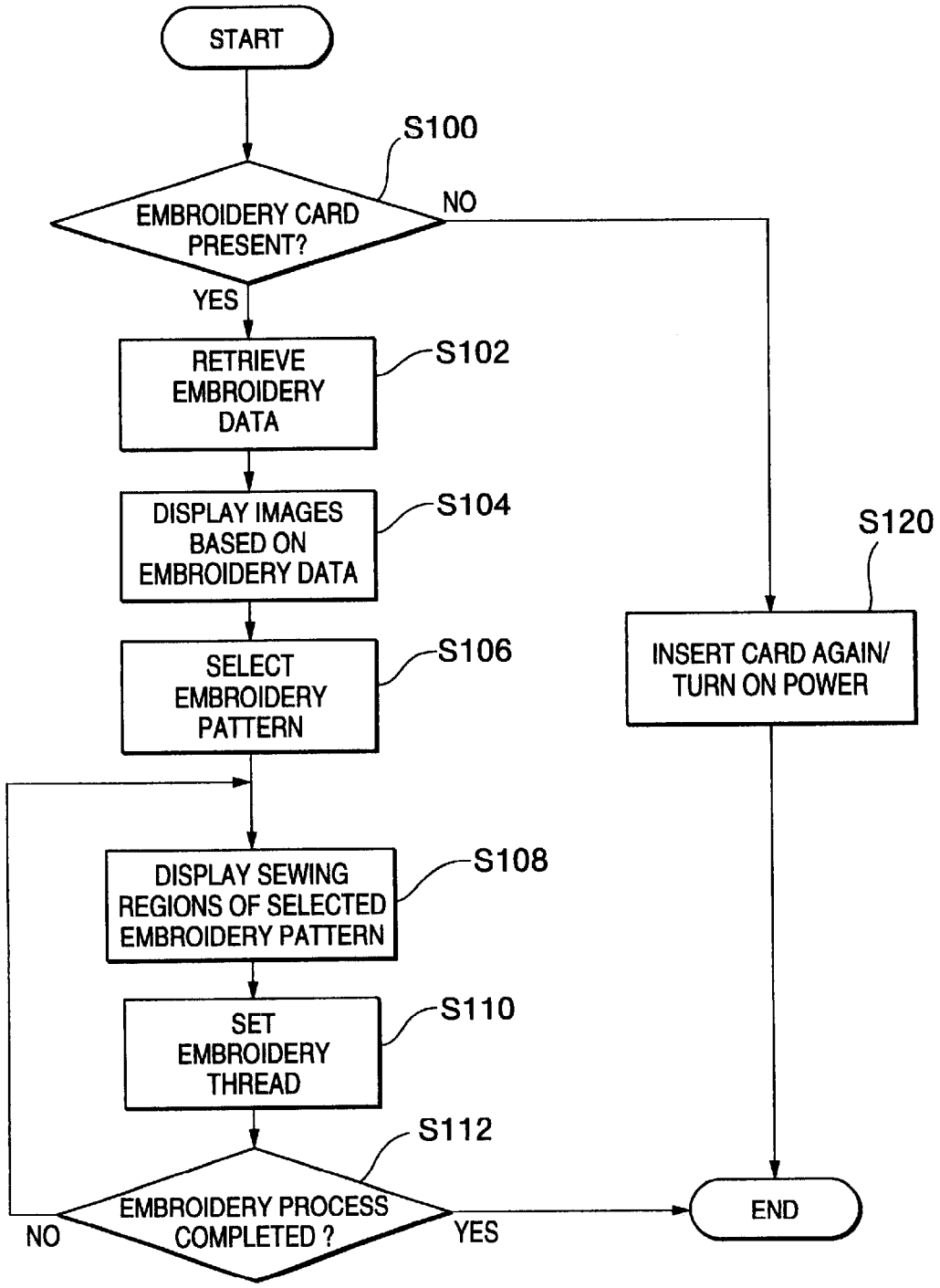
FIG. 3 is a flowchart illustrating operation of the conceivable sewing machine.

The embroidery data editing device 10 of the present embodiments can be operated together with the conceivable sewing machine 140 of FIG. 1. In this case, the embroidery color data set in S16 is written in the embroidery card 26 through the card drive 27. When the embroidery card 26, thus set with the embroidery color data, is set to the card mounting portion 143 of the sewing machine 140, the sewing machine 140 executes the process of FIG. 3 in the same manner as described already. Similarly, the embroidery color data set in S42 and the hemming color data and the hemming embroidery data set in S46 are written in the embroidery card 26 through the card drive 27. When the embroidery card 26, thus set with the embroidery color data and the hemming embroidery data, is set to the sewing machine 140, the sewing machine 140 executes the process of FIG. 3 and also sews the hems.

In the second embodiment, the memory area **25*b* of the card 26 stores therein data of embroidery colors selectable for the sewing regions of the embroidery patterns stored in the memory area 25*a*. However, the memory area 25*b* of the card 26** may store other various information on characteristics of the embroidery colors selectable for the sewing regions.

What is claimed is:

1. An embroidery data editing device for editing data to be used in an embroidery sewing machine capable of sewing embroidery, the embroidery data editing device comprising:

sewing region data storing means for storing at least one set of sewing region data indicative of at least one sewing region constituting an embroidery, each sewing region being defined as a region to be sewn by a single color, each set of sewing region data including sewing data indicative of stitches to be sewn in the corresponding sewing region;

cloth data memory means for storing cloth data indicative of color of cloth to be sewn with the embroidery;

color combination data memory means for storing a plurality of sets of color combination data indicative of a plurality of predetermined color combinations, each predetermined color combination including a plurality of colors; and embroidery color setting means for setting an embroidery color for each sewing region, indicated by the sewing region data for the embroidery to be sewn, based on the color combination data sets and on the cloth data.

2. An embroidery data editing device as claimed in claim 1, wherein the embroidery color setting means includes:

color combination selection means for selecting one set of color combination data suited for the color of the cloth indicated by the cloth data; and color setting means for respectively setting at least one of the plurality of colors, constituting the selected color combination, to the at least one sewing region.

3. An embroidery data editing device as claimed in claim 1, further comprising:

a sense keyword memory for storing data of a plurality of sense keywords each in correspondence with at least one of the plurality of sets of color combination data, each sense keyword representing a sensation evoked in individuals who view a color combination indicated by each of the corresponding at least one set of color combination data; and sense information input means for enabling a user to input information on desired sensation for the embroidery to be sewn, wherein the embroidery color setting means sets embroidery color for each sewing region indicated by the sewing region data based on the sense keyword data stored in the sense keyword memory and based on the sensation information inputted by the sense information input means.

4. An embroidery data editing device as claimed in claim 1, further comprising image display means for producing image data, based on the sewing region data stored in the sewing region memory and on the embroidery color set by the embroidery color setting means, the image display means displaying, based on the image data, a color image of the embroidery to be sewn by the set embroidery color.

5. An embroidery data editing device as claimed in claim 1, further comprising an embroidery color information memory for storing, for each sewing region indicated by the sewing region data, predetermined embroidery color characteristic information indicative of characteristic of an embroidery color to be set for the each sewing region by the embroidery color setting means, wherein the embroidery color setting means sets the embroidery color to each of the at least one sewing region based on the embroidery color characteristic information stored in the embroidery color information memory.

6. An embroidery data editing device as claimed in claim 2, wherein the color combination selection means selects one set of color combination data that includes one color approximate to the color of the cloth indicated by the cloth data, the color setting means respectively setting the at least one sewing region with the at least one of the plurality of colors constituting the selected color combination other than the color approximate to the color of the cloth.

7. An embroidery data editing device as claimed in claim 2, further comprising:

image information input means for inputting information on the color of the cloth to be sewn in the form of digital data; and cloth data production means for producing cloth data based on the digital data inputted by the image information input means.

8. An embroidery data editing device as claimed in claim 3, wherein the embroidering cloth setting means includes:

keyword selection means for selecting, from the keyword memory, one sense keyword corresponding to the inputted sensation information;

color combination selection means for selecting, from the color combination data memory, one set of color combination data corresponding to the selected sense keyword data; and color setting means for setting at least one of the plurality of colors, constituting the selected color combination, to the at least one sewing region, respectively.

9. An embroidery data editing device as claimed in claim 4, further comprising:

input means for enabling a user to input desired information;

reset determination means for determining whether or not information inputted through the input means indicates a request to reset the embroidery color; and embroidery color setting control means for, when the reset determination means determines that the inputted information is a request to reset embroidery color, controlling the embroidery color setting means to set an embroidery color different from a precedingly-set embroidery color and resetting the embroidery color.

10. An embroidery data editing device as claimed in claim 5, further comprising:

approximate color determination means for determining whether or not the embroidery color set by the embroidery color setting means is approximate to the color of the cloth indicated by the cloth data; and sewing data modification means for, based on determination results of the approximate color determination means, modifying sewing data for a sewing region, which borders against the cloth, to be embroidered in the embroidery color determined as approximate to the cloth color.

11. An embroidery data editing device as claimed in claim 7, wherein the cloth data includes cloth color data indicating a single color that represents a color state of the cloth.

12. An embroidery data editing device as claimed in claim 7, wherein the cloth data includes pattern pitch data representing a pitch of a repeating pattern formed on the cloth.

13. An embroidery data editing device as claimed in claim 8, wherein the color combination selection means selects, from the color combination data memory, one set of color combination data that corresponds to the selected sense keyword data and that includes one color approximate to the color of the cloth indicated by the cloth data, the color setting means setting, to the at least one sewing region, at least one of the plurality of colors constituting the selected color combination other than the color approximate to the color of the cloth.

14. An embroidery data editing device as claimed in claim 10, wherein the embroidery data modification means produces sewing data for forming a hem on an outer rim of the bordering sewing region to be sewn in the embroidery color determined as approximate to the cloth color.

15. An embroidery data editing device for editing data to be used in an embroidery sewing machine capable of sewing embroidery, the embroidery data editing device comprising:

embroidery data storing means for storing embroidery data indicative of an embroidery;

a sense keyword memory for storing data of a plurality of sense keywords representative of a plurality of sensations;

sense information input means for enabling a user to input information on desired sensation for the embroidery to be sewn; and sewing condition setting means for setting a sewing condition for the embroidery based on the sense keyword data stored in the sense keyword memory and the sensation information inputted by the sense information input means.

16. An embroidery data editing device as claimed in claim 15, wherein the sewing condition setting means includes embroidery color setting means for setting a color of the embroidery pattern based on the sense keyword data stored in the sense keyword memory and the sensation information inputted by the sense information input means.

17. An embroidery data editing device as claimed in claim 15, wherein the sewing condition setting means sets a size of the embroidery based on the sense keyword data stored in the sense keyword memory and based on the sensation information inputted by the sense information input means.

18. An embroidery data editing device as claimed in claim 16, further comprising cloth data memory means for storing cloth data indicative of color of cloth to be sewn with the embroidery, wherein the sewing condition setting means includes embroidery color setting means for setting the embroidery color based on the sense keyword data stored in the sense keyword memory, the sensation information inputted by the sense information input means, and the cloth data.

19. An embroidery data editing device as claimed in claim 16, wherein the sewing data storing means includes sewing region data storing means for storing sewing region data indicative of each of at least one sewing region constituting the embroidery, each sewing region being defined as a region to be sewn by a single color, further comprising color combination data memory means for storing one or more sets of color combination data in correspondence with each of the plurality of sense keyword data sets, the one or more sets of color combination data representing one or more predetermined color combinations, each of which includes a plurality of colors and each of which can evoke on its viewers the sensations represented by the corresponding sense keyword, wherein the embroidery color setting means includes:

keyword selection means for selecting, from the keyword memory, one sense keyword corresponding to the inputted sensation information;

color combination selection means for selecting, from the color combination data memory, one set of color combination data corresponding to the selected sense keyword data; and color setting means for setting at least one of the plurality of colors, constituting the selected color combination, to the at least one sewing region, respectively.

20. An embroidery data editing device as claimed in claim 19, further comprising cloth data memory means for storing cloth data indicative of color of cloth to be sewn with the embroidery, wherein the color combination selection means selects, from the color combination data memory, one set of color combination data that corresponds to the selected sense keyword data and that includes one color approximate to the color of the cloth indicated by the cloth data, the color setting means setting, to the at least one sewing region, at least one of the plurality of colors constituting the selected color combination other than the color approximate to the color of the cloth.

21. An embroidery data editing device for editing data to be used in an embroidery sewing machine capable of sewing embroidery, the embroidery data editing device comprising:

embroidery data storing means for storing embroidery data indicative of an embroidery;

cloth data memory means for storing cloth data indicative of at least one of color and pattern pitch of cloth to be sewn with the embroidery; and sewing condition setting means for setting at least one of color and size of the embroidery based on the cloth data, such that the at least one of the color and size of the embroidery is set based on the at least one of the color and pattern pitch of the cloth.

22. An embroidery data editing device as claimed in claim 21, wherein the cloth data includes pattern pitch data indicative of a pitch of a repetitive pattern formed on the cloth, and wherein the sewing condition setting means sets a size of the embroidery pattern based on the pattern pitch data.

23. An embroidery data editing device as claimed in claim 21, wherein the cloth data includes cloth color data indicative of a color of the cloth, and wherein the sewing condition setting means sets a color of the embroidery pattern based on the cloth color data.

24. An embroidery data editing device as claimed in claim 21, further comprising:

a sense keyword memory for storing data of a plurality of sense keywords representing a plurality of sensations to be evoked in individuals who view embroideries; and sense information input means for enabling a user to input information on desired sensation for the embroidery to be sewn, wherein the sewing condition setting means sets the sewing condition for the embroidery based on the cloth data, the sense keyword data stored in the sense keyword memory, and the sensation information inputted by the sense information input means.

25. A method for editing data to be used in an embroidery sewing machine capable of sewing embroidery, the method comprising the steps of:

receiving information on color of a cloth to be sewn with an embroidery in the form of digital data, the embroidery having at least one sewing region, each sewing region being defined as a region to be sewn by a single color;

producing cloth data based on the digital data;

selecting one set of color combination data, suited for the color of the cloth indicated by the cloth data, from a plurality of sets of color combination data indicative of a plurality of predetermined color combinations, each predetermined color combination including a plurality of colors; and respectively setting at least one of the plurality of colors, constituting the selected color combination, to the at least one sewing region of the embroidery.

26. A method as claimed in claim 25, further comprising the step of receiving information on a user's desired sensation for the embroidery to be sewn, wherein the color combination selection step selects one set of color combination data corresponding to the received sensation information and the cloth data.

27. A method as claimed in claim 26, wherein the color combination selection step selects one set of color combination data that corresponds to the received sensation information and that includes one color approximate to the color of the cloth indicated by the cloth data, and wherein the color setting step sets, to the at least one sewing region, at least one of the plurality of colors constituting the selected color combination other than the color approximate to the color of the cloth.

28. A method of editing data to be used in an embroidery sewing machine capable of sewing embroidery, the method comprising the steps of:

preparing data of a plurality of sense keywords representative of a plurality of sensations;

receiving information on a user's desired sensation for an embroidery to be sewn; and setting a sewing condition for the embroidery based on the sense keyword data and the received sensation information.

29. A program data storage medium for storing data of a program for editing data to be used in an embroidery sewing machine capable of sewing embroidery, the program comprising the programs of:

receiving information on color of a cloth to be sewn with an embroidery in the form of digital data, the embroidery having at least one sewing region, each sewing region being defined as a region to be sewn by a single color;

producing cloth data based on the digital data;

selecting one set of color combination data, suited for the color of the cloth indicated by the cloth data, from a plurality of sets of color combination data indicative of a plurality of predetermined color combinations each predetermined color combination including a plurality of colors; and respectively setting at least one of the plurality of colors, constituting the selected color combination, to the at least one sewing region of the embroidery.

30. An embroidery data editing device for editing data to be used in an embroidery sewing machine capable of sewing embroidery, the embroidery data editing device comprising:

sewing region data storing means for storing at least one set of sewing region data indicative of at least one sewing region constituting an embroidery, each sewing region being defined as a region to be sewn by a single color, each set of sewing region data including sewing data indicative of stitches to be sewn in the corresponding sewing region;

background data memory means for storing background data indicative of color of a background to be sewn with the embroidery;

color combination data memory means for storing a plurality of sets of color combination data indicative of a plurality of predetermined color combinations, each predetermined color combination including a plurality of colors;

embroidery color setting means for setting an embroidery color for each sewing region, indicated by the sewing region data for the embroidery to be sewn, based on the color combination data sets and on the background data; and image display means for producing image data, based on the sewing region data stored in the sewing region data storing means, on the background data stored in the background data memory means, and on the embroidery color set by the embroidery color setting means, the image display means displaying, based on the image data, a color image of the embroidery to be sewn on the background.

31. An embroidery data editing device as claimed in claim 30, wherein the background data memory means stores cloth data indicative of color of a cloth to be sewn with the embroidery, wherein the embroidery color setting means sets an embroidery color for each sewing region based on the color combination data sets and on the cloth data, and wherein the image display means produces the image data, based on the sewing region data stored in the sewing region memory, on the cloth data stored in the background data memory means, and on the embroidery color set by the embroidery color setting means, the image display means displaying, based on the image data, a color image of the embroidery to be sewn on the cloth.

32. An embroidery data editing device for editing data to be used in an embroidery sewing machine capable of sewing embroidery, the embroidery data editing device comprising:

sewing region data storing means for storing at least one set of sewing region data indicative of at least one sewing region constituting an embroidery, each sewing region being defined as a region to be sewn by a single color, each set of sewing region data including sewing data indicative of stitched to be sewn in the corresponding sewing region;

background data memory means for storing background data indicative of color of a background to be sewn with the embroidery;

color combination data memory means for storing a plurality of sets of color combination data indicative of a plurality of predetermined color combinations, each predetermined color combination including a plurality of colors; and image display means for producing image data, indicative of a candidate of a color combination of the embroidery, based on the sewing region data stored in the sewing region data storing means, on the background data stored in the background data memory means, and on one set of color combination data stored in the color combination data memory means, the image display means displaying, based on the image data, a color image of the candidate embroidery to be sewn on the background.

33. An embroidery data editing device as claimed in claim 32, wherein the background data memory means stores cloth data indicative of color of a cloth to be sewn with the embroidery, the image display means producing the image data, based on the sewing region data in the sewing region data storing means, on the cloth data stored in the background data memory means, and on one set of color combination data stored in the color combination data memory means, the image display means displaying, based on the image data, the color image of the candidate embroidery to be sewn on the cloth.

34. An embroidery data editing device as claimed in claim 32, further comprising confirmation means for allowing a user to input his/her confirmation whether the color image of the candidate embroidery, which is displayed by the image display means, is acceptable to the user.

* * * * *